US007901343B2

(12) United States Patent
Dudrey et al.

(10) Patent No.: US 7,901,343 B2
(45) Date of Patent: Mar. 8, 2011

(54) METHODS AND APPARATUS FOR CENTRIFUGING DRY SOLIDS

(75) Inventors: Denis J. Dudrey, Bloomington, MN (US); James N. Gehrking, Burnsville, MN (US); Adelbert Gorham, Burnsville, MN (US); Ronald L. Jorgenson, Apple Valley, MN (US); Rodger I. Spears, Bloomington, MN (US); Lloyd E. Weisert, Bloomington, MN (US)

(73) Assignee: Advanced Products Laboratories, Inc., Burnsville, MN (US)

( * ) Notice: Subject to any disclaimer, the term of this patent is extended or adjusted under 35 U.S.C. 154(b) by 889 days.

(21) Appl. No.: 11/830,775

(22) Filed: Jul. 30, 2007

(65) Prior Publication Data

US 2008/0026926 A1 Jan. 31, 2008

Related U.S. Application Data

(60) Provisional application No. 60/834,246, filed on Jul. 31, 2006.

(51) Int. Cl.
*B04B 11/06* (2006.01)
*B04B 11/08* (2006.01)

(52) U.S. Cl. ..... 494/55; 494/67; 494/84

(58) Field of Classification Search ..... 494/50–55, 494/65, 67, 84; 210/374
See application file for complete search history.

(56) References Cited

U.S. PATENT DOCUMENTS 866,844 A 9/1907 Cottrell
1,048,846 A 12/1912 Mattern
2,450,737 A 10/1948 Rundquest
3,403,848 A * 10/1968 Windsor et al. ..... 494/11
3,741,465 A * 6/1973 Lincoln ..... 494/55
3,858,793 A 1/1975 Dudrey
(Continued)

FOREIGN PATENT DOCUMENTS

CH 604906 A5 * 9/1978
(Continued)

OTHER PUBLICATIONS

Riesberg, K., et al., "New Bowl Centrifuge Design Cuts Metalworking Coolant Costs", "Filtration Engeering", May/Jun. 1972.

*Primary Examiner* — Charles E Cooley
(74) *Attorney, Agent, or Firm* — Charles A. Lemaire; Jonathan M. Rixen; Lemaire Patent Law Firm, P.L.L.C.

(57) ABSTRACT

The present invention provides a self-cleaning drying centrifuge for removing fluid from a concentrated particulate-filled fluid and peeling mostly dried particulate (solid) material from the centrifuge. In some embodiments, a high-efficiency centrifuge performs an initial separation and concentration of small particles from a contaminated fluid, and outputs a clarified fluid for reuse, and periodically purges concentrated particulates with high fluid content. The purged concentrate is then fed into the present invention's drying centrifuge, which substantially reduces the remaining fluid content. In some embodiments, the drying centrifuge is periodically stopped and one or more internal blades (peelers) are rotated around the inner wall of the drying centrifuge bowl to peel the accumulated solids, which drop into a collection container. In some embodiments, partial peelers are arranged in a balanced configuration, but each peel portions of the bowl not peeled by others, to reduce the brake size needed to hold the bowl.

16 Claims, 8 Drawing Sheets

U.S. PATENT DOCUMENTS

| | | | | | |
|---|---|---|---|---|---|
| 3,861,584 | A | | 1/1975 | Dudrey | |
| 4,030,897 | A | | 6/1977 | Pelzer et al. | |
| 4,350,282 | A | | 9/1982 | Dudrey et al. | |
| 4,406,651 | A | | 9/1983 | Dudrey et al. | |
| 4,416,655 | A | * | 11/1983 | Bennett | 494/40 |
| 5,250,180 | A | * | 10/1993 | Chang | 210/375 |
| 5,344,382 | A | | 9/1994 | Pelzer | |
| 5,454,777 | A | * | 10/1995 | Ziems et al. | 494/8 |
| 5,935,053 | A | | 8/1999 | Strid et al. | |
| 6,056,685 | A | | 5/2000 | Nelson | |
| 6,126,587 | A | * | 10/2000 | Berger et al. | 494/55 |
| 6,149,573 | A | * | 11/2000 | Berger et al. | 494/55 |
| 6,248,054 | B1 | * | 6/2001 | Berger et al. | 494/55 |
| 6,251,056 | B1 | * | 6/2001 | Berger et al. | 494/55 |
| 6,357,958 | B1 | | 3/2002 | Geib et al. | |
| 6,932,757 | B2 | * | 8/2005 | Beattey | 494/55 |
| 6,997,860 | B2 | * | 2/2006 | Opfer | 494/55 |
| 7,044,904 | B2 | * | 5/2006 | Beattey | 494/55 |
| 7,077,799 | B2 | | 7/2006 | Gorham et al. | |
| 2008/0026926 | A1 | * | 1/2008 | Dudrey et al. | 494/55 |

FOREIGN PATENT DOCUMENTS

| | | | | |
|---|---|---|---|---|
| JP | 08131894 | A | * | 5/1996 |
| JP | 8-266936 | | * | 10/1996 |
| JP | 09262502 | A | * | 10/1997 |
| JP | 2000140704 | A | * | 5/2000 |
| JP | 2003144973 | A | * | 5/2003 |
| JP | 2007190493 | A | * | 8/2007 |
| WO | WO 8804950 | | | 7/1988 |

* cited by examiner

METHODS AND APPARATUS FOR CENTRIFUGING DRY SOLIDS

CROSS REFERENCED RELATED APPLICATIONS

This application claims priority to U.S. Provisional Patent Application Ser. No. 60/834,246 filed Jul. 31, 2006, which is incorporated herein by reference. This application is also related to U.S. Pat. No. 7,077,799, which is also incorporated herein by reference.

FIELD OF THE INVENTION

The present invention relates generally to the field of centrifuging systems. More particularly, the present invention relates to methods and apparatus for economically separating particles from particle-laden fluid and discharging the particulate as dry or nearly dry solids.

BACKGROUND OF THE INVENTION

Centrifuges are commonly used for fluid clarification in a wide variety of industrial applications such as grinding, honing, quench oils, thread rolling, vibratory finishing and many others. Some are manually cleaned when loaded with solids. Others discharge the collected solids automatically. Some automatically cleaned centrifuges discharge the solids as in the form of slurry along with a significant quantity of fluid. Others discharge the solids as a wet sludge.

There is a growing need, based on cost and environmental concerns, to produce solids in a dry or nearly dry state to facilitate disposal. Slurries, saturated solids, and loaded liquid filters pose significant handling and disposal problems.

Centrifuges designed to discharge nearly dry solids involve complicated and costly construction and high horsepower in order to accomplish their intended function. Decanter centrifuges involve a helix blade or blades that are geared to rotate at a speed slightly different than the bowl. This causes collected solids to be augured up a tapered portion of the bowl, called the beach, and out the open end of the bowl. The tapered portion of the bowl extends inside of the liquid surface. As solids move up the incline liquid is drained from the solids, which are discharged in a semi dry state. The decanter centrifuge has been proven practical in many material processing applications, but because of the complex design is too costly for many liquid clarifying applications.

Another class of centrifuges intended to discharge semi-dry solids incorporates an inclined blade positioned against the inside wall of a vertical bowl. To discharge collected solids, the rotating bowl is stopped and free liquid is allowed to drain from the bowl. A liquid collector is positioned under the bowl to catch the draining liquid. Once the liquid has drained this collector is withdrawn. The bowl is then held stationary while the blade is slowly rotated to plow the collected solids from the bowl inside wall and allow them to fall out the bottom of the bowl into a solids receptacle. The plowing process requires high forces to move the blade imbedded in the layer of solids. The plowed solids still contain a significant quantity of liquid and are wetter than desired in many applications making disposal more troublesome. This class of centrifuges has been successfully applied for a wide range of industrial applications. Because of wetness of the solids, and the complexity and cost of this class of centrifuges, they are impractical for many clarifying applications.

SUMMARY OF THE INVENTION

The present invention provides a self-cleaning drying centrifuge for removing fluid from a concentrated particulate-filled fluid and peeling mostly dried particulate (solid) material from the centrifuge. In some embodiments, a high-efficiency centrifuge performs an initial separation and concentration of small particles from a contaminated fluid, and outputs a clarified fluid for reuse, and periodically purges concentrated particulates with high fluid content. The purged concentrate is then fed into the present invention's drying centrifuge, which substantially reduces the remaining fluid content. In some embodiments, the drying centrifuge is periodically stopped and one or more internal blades (peelers) are rotated around the inner wall of the drying centrifuge bowl to peel the accumulated solids, which drop into a collection container. In some embodiments, partial peelers are arranged in a balanced configuration, but each peel portions of the bowl not peeled by others, to reduce the brake size needed to hold the bowl.

In some embodiments, the present invention provides a centrifuge apparatus for extracting solids from an incoming particle-laden fluid. This the apparatus includes a centrifuge bowl, wherein the bowl includes a cylindrical inner-wall surface and an open bottom, and wherein the bowl is configured to rotate around an axis of rotation, and wherein the bowl includes a bowl cover connected to a top of the centrifuge bowl, a particle-laden-fluid catcher fastened to an upper surface of the bowl cover, the fluid catcher having a smaller upper opening and a larger lower portion, the fluid catcher centered around the axis of rotation of the bowl and configured to receive the incoming particle-laden fluid, a plurality of outward-directed passages each having in inner end and an outer end, each one of the plurality of outward-directed passages configured to receive the particle-laden-fluid from the catcher at its inner end, and to extend outward such that the incoming particle-laden-fluid as it travels through the plurality of outward-directed passages is rotationally accelerated to a first rotational speed and is distributed substantially uniformly around an upper portion of the inner-wall surface of the bowl at the first rotational speed, and wherein the first rotational speed is close to a second rotational speed of the inner-wall surface, wherein a layer of solids from the particle-laden-fluid collects on the inner-wall surface of the bowl during operation of the apparatus, one or more peeler blades located inside the centrifuge bowl, wherein the one or more blades are configured be moved relative to the bowl to peel a layer of solids from the inner-wall surface of the bowl, and a slowing device operatively coupled to the centrifuge bowl, wherein the slowing device is configured to slow the bowl from its centrifugal motion and hold the bowl in a substantially stopped position while the blades peel the layer of solids from the bowl. In some embodiments of this apparatus, each of the one or more peeler blades includes a curling surface that curls the accumulated solids as they are peeled from the centrifuge bowl.

In some embodiments of this apparatus, the bowl cover includes a plurality of inlet holes through the bowl cover that are positioned at a maximum inside diameter of the particle-laden-fluid catcher, and wherein each one of the plurality of inlet holes connects to a corresponding one of the plurality of outward-directed passages, and wherein the particle-laden-fluid catcher is shaped as a section of a cone such that an incoming liquid entering the cone during rotation will flow to the larger-diameter lowest end of the cone and pass through the inlet holes in the bowl cover without depositing solids on an inside surface of the particle-laden-fluid catcher.

In some embodiments of this apparatus, the bowl cover includes a first layer, a second layer, and a third layer, and wherein the second layer is located in between the first layer and the third layer, and wherein second layer is made as a single piece with the particle-laden-fluid catcher, and wherein the plurality of outward-directed passages are located, at least in part, in the second layer and lead from the particle-laden-fluid catcher at their inner ends and include side walls that extend to substantially the inner diameter of the bowl at the outer ends of the outward-directed passages.

Some embodiments further include a vibratory-finishing machine, wherein the vibratory finishing machine is configured to remove unwanted finish from an object, and wherein the vibratory-finishing machine uses a combination of a media, a removal compound, and a clarified fluid, and wherein the vibratory-finishing machine is configured to output a high-flow, low-solids waste stream, and a high-efficiency, self-cleaning centrifuge, and wherein the high-efficiency centrifuge is configured to receive and clarify the high-flow, low-solids waste stream, and to output the clarified fluid and to output a low-flow, high-solids waste stream, wherein the apparatus is configured to feed the low-flow, high-solids slurry into the particle-laden-fluid catcher and to feed the clarified fluid to the vibratory-finishing machine.

In some embodiments, the present invention provides a method for extracting solids from an incoming particle-laden fluid This method includes rotating a centrifuge bowl at a centrifugally effective rate around an axis of rotation, wherein the bowl includes a cylindrical inner-wall surface and an open bottom, wherein the rotating achieves a first tangential speed of the inner-wall surface of the centrifuge bowl, feeding particle-laden fluid into an upper portion of the centrifuge bowl (wherein the feeding includes: catching the particle-laden fluid, radially accelerating the particle-laden fluid to a second tangential speed, wherein the second tangential speed is close to the first tangential speed of the inner-wall surface of the centrifuge bowl, and flowing the particle-laden fluid downward over the inner-wall surface of the centrifuge bowl, wherein the flowing includes accumulating solids from the particle-laden fluid by centrifugal force onto the inner-wall surface such that the particle-laden fluid becomes a centrifuged fluid that exits the bowl), reducing the feeding of the particle-laden fluid until the feeding is substantially stopped, slowing the rotating of the centrifuge bowl around the axis of rotation until the rotating is substantially stopped, peeling the solids off of the inner-wall surface, wherein the peeling includes collecting the solids as they drop through the open bottom of the centrifuge bowl, restarting the rotating of the centrifuge bowl, and restarting the feeding of the particle-laden fluid.

In some embodiments, the present invention provides an apparatus for extracting solids from an incoming particle-laden fluid. This apparatus includes a centrifuge bowl, wherein the bowl includes a cylindrical inner-wall surface and an open bottom, means for rotating the centrifuge bowl at a centrifugally effective rate around an axis of rotation, wherein the rotating achieves a first tangential speed of the inner-wall surface of the centrifuge bowl, means for feeding and radially accelerating the particle-laden fluid to a second tangential speed, wherein the second tangential speed is close to the first tangential speed of the inner-wall surface of the centrifuge bowl, and for accumulating solids from the particle-laden fluid on the inner-wall surface, and means for peeling the solids off of the inner-wall surface so they drop through the open bottom of the centrifuge bowl.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DESCRIPTION OF EMBODIMENTS

In the following detailed description, reference is made to the accompanying drawings which form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

The present invention provides a centrifuge design for producing dry solids that overcomes the cost and complexity problems associated with conventional centrifuge designs.

This type of centrifuge design is called a "dry-solids centrifuge" or "drying centrifuge" since one goal is to remove almost all liquid from a fluid having a concentration of solid material, leaving a cake of solid and particulate material spin dried to the inside of the centrifuge bowl (sometimes called a drum), and this cake is then peeled or scraped off the bowl into an external container. In some embodiments, a very small amount of liquid is left in the cake (leaving it slightly damp) to prevent dust from the cake from being sent into the air when the cake is peeled and drops into the external container.

Figure 1A:
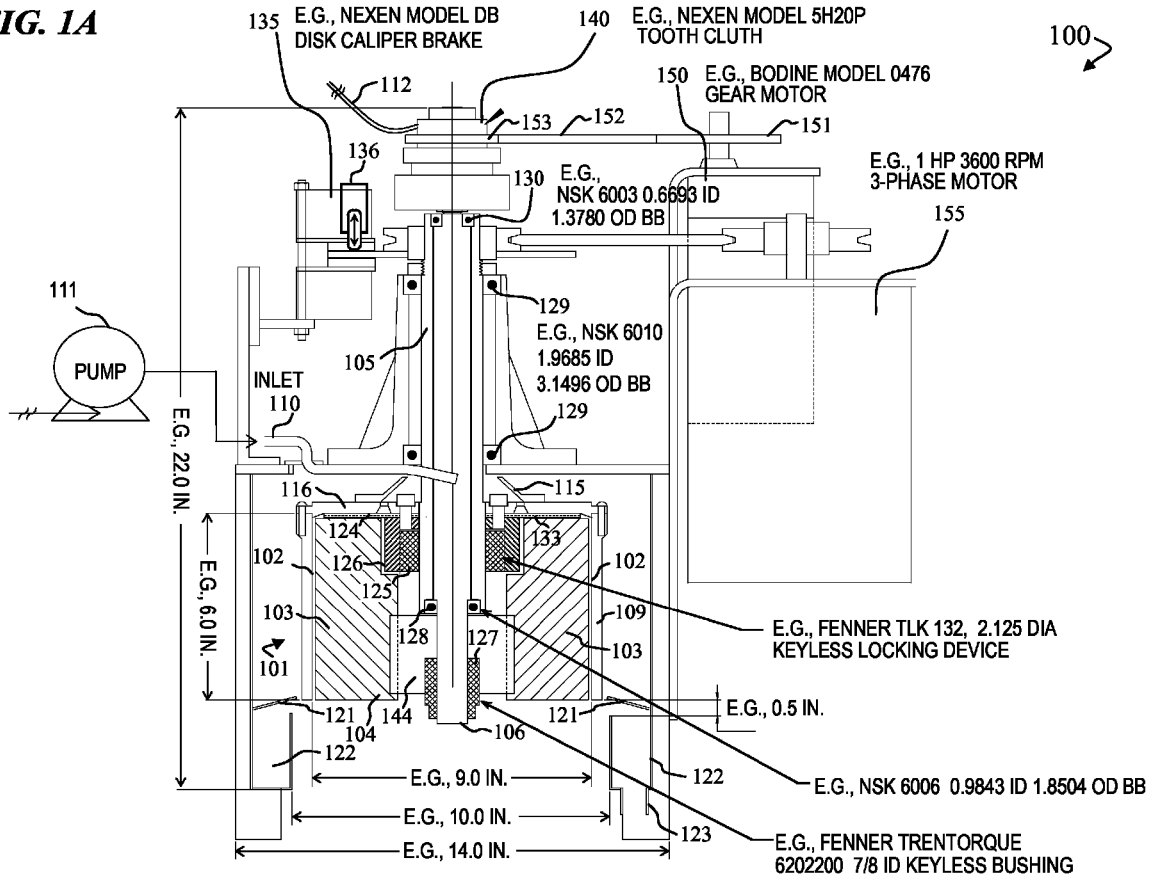
FIG. 1A is a schematic diagram of one embodiment of a dry-solids (drying) centrifuge 100.

FIG. 1A is a schematic side-cross-section diagram of one embodiment of the drying centrifuge 100 that separates substantially dry solids from a concentrated-particulates fluid material. The dimensions shown in FIG. 1A (as well as the dimensions shown in the other figures found in this specification) represent one embodiment of the present invention, and other embodiments use other suitable dimensions. In some embodiments, centrifuge 100 includes a centrifuge bowl assembly 101 having a cylindrical inner bowl wall surface 102 of bowl cylinder 109, and an open bottom without the conventional lip typically included in conventional centrifuges at the bottom to retain liquid within the bowl. In some embodiments, the bowl assembly 101 is rapidly rotated using vertical hub 105. Fluid having a particulate content is inserted inside a top-mounted wet-material catcher (e.g., a cone section) 115, and centrifugal forces push the fluid to the bottom outer diameter of the cone 115 and through accelerating passages that lead to the top of the cylinder wall 102, and the liquid sheets down the wall 102—depositing the solids on the wall 102. The remaining liquid exits radially from the bottom lip of wall 102, and is caught by circumferential trough 122, which has a cover 121 and drain 123.

Periodically (e.g., in some embodiments, once every 7.5 minutes, or every 10 minutes, or every 15 minutes (i.e., 8, 6, or 4 times per hour) or other suitable period), once sufficient solids have been collected on the inside of centrifuge bowl assembly 101, brake 135 is applied to stop centrifuge bowl assembly 101. In some embodiments, the fluid stops being fed into centrifuge bowl assembly 101 for a short period of time (e.g., for 15 seconds, in some embodiments, or for about 5, 10, 20, 30, 40, 50, or 60 seconds, or for longer than 60 seconds in other embodiments) just before braking, in order that the accumulated solids can be spin-dried (i.e., to provide time for removal of the liquid portion of the final fluid inserted to the centrifuge bowl assembly 101). In some embodiments, brake 135 has a pneumatically activated caliper. In some embodiments, once the brake 135 has substantially stopped bowl assembly 101 for cleaning, air pressure is provided to activate a tooth clutch 140 of centrifuge 100 via an air inlet 112, such that a top-mounted sprocket 153, which is affixed to peeler shaft 106, and gear motor 150 is turned on to drive a chain 152 between its sprocket 151 and peeler-shaft sprocket 153. This rotates peeler shaft 106, which drives one or more peeler assemblies 103 (also called blade assemblies 103 or scraper-blade assemblies 103) around the inner circumference of wall 102, peeling and/or scraping the accumulated solids, which then drop by gravity into a collection vessel (not shown).

In the embodiment shown, the peeler blades extend in a direction parallel to the axis of the centrifuge bowl 101. This simplifies fabrication of the blades. In other embodiments, the blades are formed to a helical shape, wherein the axis of the helix coincides with the axis of bowl 101. The helical shape can enhance the peeling and/or slicing of the cake when it is removed from the bowl 101, reducing the force on the blade-rotating motor 150 and on the brake 135.

In some embodiments, wet-material catcher 115 is a hollow section of a cone as shown in the accompanying figures; however, in other embodiments, the cone section is replaced by another suitable shape, such as a hemisphere. While the following discussion refers to wet-material or particulate-laden-fluid catcher 115 as cone 115, it is to be understood that other shapes may be used in other embodiments.

In some embodiments, a fluid-entry means (e.g., fluid-inlet tube 110, cone 115, and fluid-acceleration channels 124) distributes incoming fluid uniformly around the upper end of the bowl inside wall 102 at a rotational speed close to the speed of the bowl inside wall 102. In some embodiments, the fluid entry means includes one or more inlet ducts (e.g., inlet tube 110) of suitable design that direct incoming solids-laden liquid into a downward-and-outward-slanting cone section 115 fastened to the top of the upper bowl cover 116 (also called top plate 116) (e.g., by bolts, adhesive, welding, or other suitable fastening means), which is thus affixed to and rotates with the bowl assembly 101. In some embodiments, the fluid-entry means also includes one or more feed pumps 111 connected to the inlet ducts 110 such that the pump(s) 111 push the incoming liquid into centrifuge 100. In some embodiments, the cone 115 has an angle of approximately forty-five degrees, but other embodiments use angles ranging from thirty degrees (or less) to sixty degrees (or more). In some embodiments, the height of the cone 115 is approximately one inch (2.54 cm) but could vary significantly from that, depending on the overall size of the centrifuge 100 and other design considerations (e.g., a larger cone could reduce splashing, while a smaller cone could reduce centrifugal forces on the cone itself). In some embodiments, cone 115 is positioned as close as practical to the center of the bowl cover 116. The intention is to keep the centrifugal separation forces low to avoid collection of liquid-borne particles on the inner surface of the cone 115.

In some embodiments, a locking assembly 125 is used to mount items (e.g., via support ring 126) to the underside of bowl cover 116 and the hub 105 (i.e., in some embodiments, locking assembly 125 locks support ring 126 to hollow hub 105, and bowl cover 116 is bolted to support ring 126). In some embodiments, locking assembly 125 includes a Tollok® Keyless Locking Assembly (available from Fenner Drives®). In some embodiments, the locking assembly 125 is connected to a support ring 126. In some embodiments, support ring 126 includes an integral steel cover 133 (also called lower bowl cover 133) that has a plurality of radial channels 124 machined into its upper surface, these channels being enclosed when support ring 126 and its steel cover 133 are bolted to bowl cover 116.

In some embodiments, hub 105 is hollow and surrounds a peeler shaft 106 (also called scraper-blade shaft 106). In some embodiments, a center mounting plate 144 or like device is attached to the scraper-blade shaft 106 via a bushing 127, and to mounting device 104 (e.g., also called wing mounting plates 104 or attachment plates 104) by suitable means (e.g., welding or bolts, in some embodiments). In some embodiments, the bushing 127 includes a Trantorque® Keyless Bushing (available from Fenner Drives®). In some embodiments, one or more peeler assemblies 103 are attached to the mounting device 104.

In some embodiments, one or more sets of ball bearings 128 are located around the lower portion of the peeler shaft 106. In some embodiments, the ball bearings 128 have an inside diameter of 0.9843 inches (2.50 cm.) and an outside diameter of 1.8504 inches (4.70 cm.). In some embodiments, one or more sets of ball bearings 129 are located around the middle portion of the hub 105. In some embodiments, the ball bearings 129 have an inside diameter of 1.9685 inches (5.00 cm.) and an outside diameter of 3.1496 inches (8.00 cm.). In some embodiments, one or more sets of ball bearings 130 are located around the top portion of the scraper-blade shaft 106. In some embodiments, the ball bearings 130 have an inside diameter of 0.6693 inches (1.70 cm.) and an outside diameter of 1.3780 inches (3.50 cm.).

In some embodiments, the centrifuge 100 includes a bowl motor drive 155 that provides power to rotate the centrifuge bowl 101. In some embodiments, the centrifuge 100 includes a blade motor drive 150 that provides power to rotate the peeler assemblies 103. In some embodiments, the blade motor drive 150 is operatively coupled to a tooth clutch 140 that is connected to the peeler assemblies 103 via the scraper blade shaft 106 and the mounting device 104. In some embodiments, the centrifuge 100 includes braking means 135 to stop the bowl 101 and hold it in position during the scraping, i.e., peeling of solids.

Figure 1B:
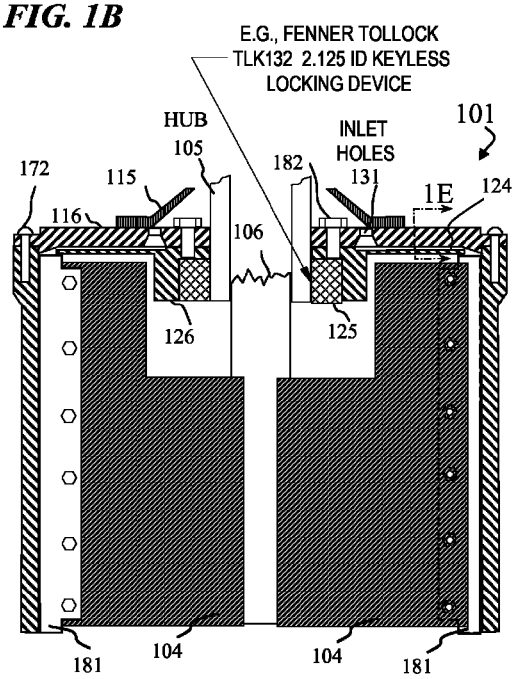
FIG. 1B is a cross-sectional view of one embodiment of a centrifuge bowl assembly 101.

FIG. 1B is a cross-sectional view of one embodiment of a centrifuge bowl assembly 101. In some embodiments, bowl assembly 101 includes a peeler shaft 106 connected to mounting device 104, each of which has one or more peeler blades 181 (e.g., connected by bolts). For cleaning, the bowl assembly 101 is substantially stopped (after the input fluid is stopped and the centrifuge 100 is run for a short time to spin-dry the accumulated solids (sometimes called "cake")), and shaft 106 is rotated so peeler blades 181 remove accumulated solids, which then drop out the bottom to a container (not shown) for later removal. Once cleaned of solids (cake), bowl assembly 101 is again rotated using hub 105 and fluids are again squirted into cone 115, where the fluid travels to the outer diameter of cone 115, through holes 131 that pass through upper bowl cover 116, into and through passageways 124, where the fluids are tangentially accelerated to very nearly the tangential velocity of the inner wall 102 of bowl assembly 101. This tangential acceleration is important in some embodiments to provide smooth and even distribution of fluids around the circumference of inner wall 102 of bowl assembly 101, in order to prevent rivulets or streams of fluid down inner wall 102 of bowl assembly 101, which would otherwise reduce the efficiency of solids separation and/or cause an out-of-balance condition in centrifuge bowl 101. In some embodiments, the portion of fluid that does not get accelerated to the full tangential velocity of the inner wall 102 of bowl assembly 101 will "slide" circumferentially sideways until reaching blade 181, where such "sliding" stops. In some embodiments, passageways 124 are extended as far radially as possible to reduce such "sliding" and resulting accumulation of fluid at blades 181.

To avoid collection of liquid borne particles within the inlet holes 131 several options are possible. In some embodiments, a thin cover section is provided at the location of the holes 131 (or slots 124). In other embodiments, the undersides of the holes 131 are chamfered. In still other embodiments, the holes 131 are slanted outwards.

In some embodiments, the one or more peeler assemblies 103 are shaped and positioned to "peel" rather than plow the collected solids from the bowl inside wall 102. The peeling method of removing collected solids has two benefits. First, forces are greatly reduced as shearing or peeling of the solids away from the wall 102 involves far less force than pushing a radial blade face through the hard-packed cake of solids. Secondly, the peeling method involves more shearing at the interface of solids and blade, resulting in less sticking of the solids to the blade.

Figure 1C:
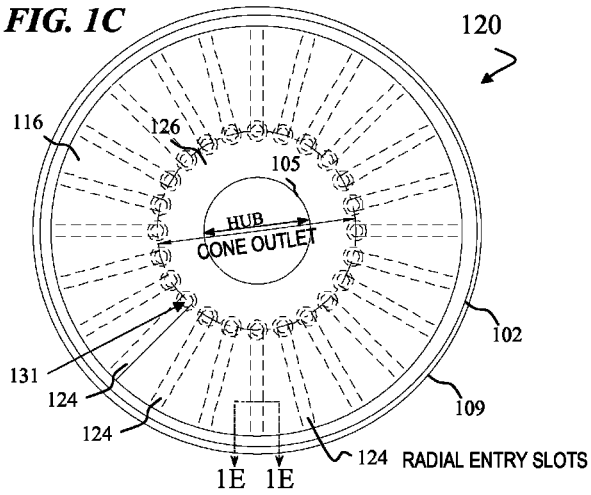
FIG. 1C is a schematic diagram of the centrifuge bowl cover assembly 120.
Figure 1D:
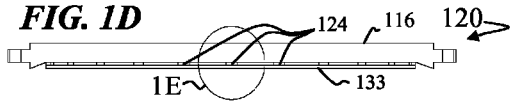
FIG. 1D is an edge view schematic diagram of the centrifuge bowl cover assembly 120.
Figure 1E:
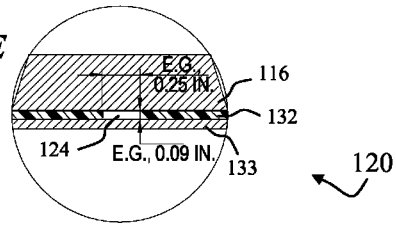
FIG. 1E is an enlarged detail cross-sectional view of the centrifuge bowl cover assembly 120.

FIG. 1C is a schematic bottom-view diagram of the centrifuge bowl cover assembly 120. FIG. 1D is an edge cross-section view schematic diagram of the centrifuge bowl cover assembly 120, showing bowl cover 116. FIG. 1E is an enlarged detail cross-sectional view of the centrifuge bowl cover assembly 120. In some embodiments, bowl cover assembly 120 includes a top plate 116 having a plurality of holes 131 there through, each hole providing fluid passage from the bottom of cone 115 to the radial passageways or channels 124 in the steel cover of support ring 126 (in some embodiments, channels 124 are machined into the upper surface of steel cover 133 (see FIG. 1E) of support ring 126, while in other embodiments, the channels 124 are formed by a separate plastic or aluminum insert 132), and these channels are enclosed when support ring 126 and its steel cover 133 are bolted to bowl cover 116. In other embodiments (not shown), the channels 124 are formed in a plastic insert that is clamped between support ring 126 and its steel cover 133 and bowl cover 116 when these are bolted together. In some embodiments, support ring 126 is locked to hub 105 by locking device 125 (see FIG. 1B).

Figure 2A:
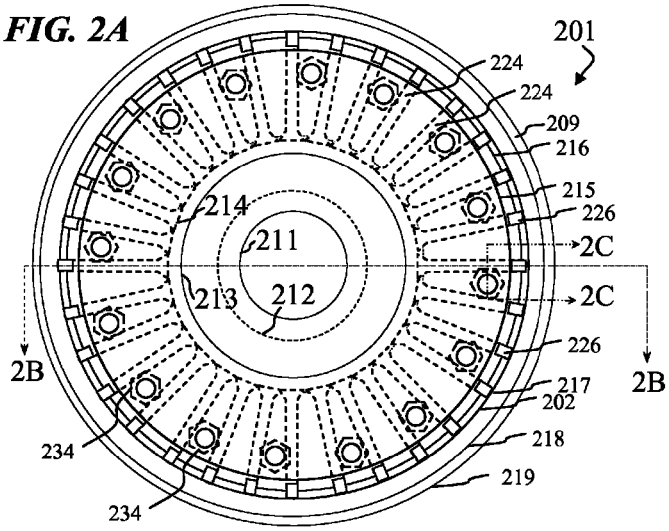
FIG. 2A is bottom view of an alternative centrifuge bowl assembly 201.

FIG. 2A is bottom view of an alternative centrifuge bowl assembly 201.

Figure 2D:
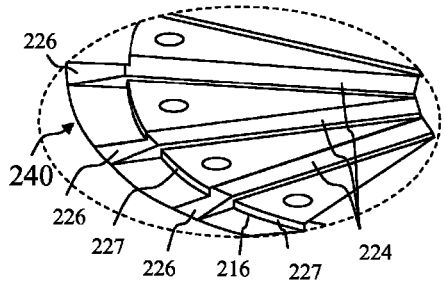
FIG. 2D is an enlarged perspective view of a portion the bottom of fluid-accelerating channel unit 240, according to some embodiments.
Figure 2B:
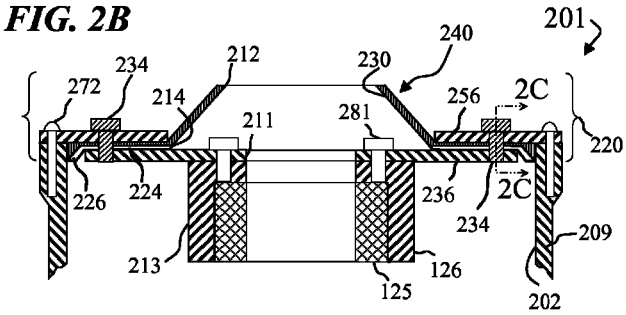
FIG. 2B is side elevation cross-sectional view of the upper portion of one embodiment of centrifuge bowl assembly 201.

FIG. 2B is side elevation cross-sectional view of the upper portion of one embodiment of centrifuge bowl assembly 201. In some embodiments, bowl assembly 201 is used in place of bowl assembly 101 in centrifuge 100 of FIG. 1A. In some embodiments, the bottom of cone 230 leads directly to the plurality of radial fluid-accelerating passageways 224 that extend directly from the maximum inside diameter of the cone 230 so that liquid entering the rotating cone 230 will immediately pass into fluid-accelerating passageways 224 without depositing any solids on the inside surface of the cone 230. In some embodiments, each of the plurality of radial fluid-accelerating passageways 224 extend directly to the maximum inside diameter of the bowl cylinder 209, such that the fluid leaving passageways 224 is substantially at the tangential velocity of bowl wall 202. Circle 211 represents the outer diameter of hub 105, circle 212 represents the top inner edge of cone 230, circle 213 represents the outer wall of support ring 126, circle 214 represents the bottom outer edge of cone 230, circle 215 represents the outer edge of bottom plate 236, circle 216 represents the bottom inner edge (between channels 224) of channel plate 240 (also called fluid-accelerating channel unit or assembly 240, which, in some embodiments, includes a cone 230), circle 217 represents the bottom outer edge of channel plate 240 (the fluid exit point of channels 224, which coincides with bowl inner wall 202), circle 218 represents the lower outer wall of bowl cylinder 209 (which is thinner to reduce the mass of bowl assembly 201), and circle 219 represents the upper outer wall of bowl cylinder 209 (which is thicker to receive bolts 272). Bolts 234 are used to clamp bottom plate 236 to top plate 256 and hold channel assembly 240 between them. In some embodiments, each channel 224 has an inner opening that directly receives fluid from cone 230 and a ramp 226 at is outer end that has side walls that continue to accelerate the fluid to the ends of the ramp 226 and that deposit the tangentially accelerated fluid onto the top edge of wall 202.

Figure 2C:
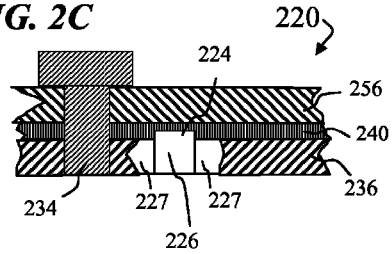
FIG. 2C is an enlarged detail side cross-sectional view of the centrifuge bowl cover assembly 220.

FIG. 2C is an enlarged detail side cross-sectional view of the centrifuge bowl cover assembly 220 (which includes top plate 256, cone-and-channel middle section 240, bottom plate 236 and bolts 234 that clamp and hold the other three pieces 256, 240, and 236 together). In some embodiments, (as compared to the embodiment shown in FIG. 1B, each of the inlet holes 131 in the cover 116 in bowl assembly 101 are replaced by the opening to a corresponding radial slot 224 in bowl assembly 201) the outer lower rim of cone 230 connects with (i.e., directs incoming fluid into) the plurality of radial slots

224. In some embodiments, the greater the number of radial slots 224, the more evenly the incoming fluid spread will be around the centrifuge bowl assembly 101 or 201.

In some embodiments, the cover assembly 220 includes a bottom plate 236, a middle section 240 adjacent bottom plate 236, and a top plate 256 connected to the top side of the middle section 240, wherein, in some embodiments, the radial slots 224 are formed (e.g., molded or machined) in the middle section 240. In some embodiments, cone 230 and middle section 240 are combined into a single piece and are molded plastic (e.g., polycarbonate or other suitable plastic) or cast or machined metal (e.g., aluminum). In some embodiments, as shown in FIG. 2C, layers 236 and 256 are metal or include a metal, while middle section 240 is plastic or includes a plastic (such as polycarbonate or other suitable plastic or composite (e.g., one reinforced with glass or carbon fibers), for example). In some embodiments, layers 236, 240, and 256 all include a metal (such as steel or aluminum, for example). In some embodiments, the middle section 240 and the bottom layer 236 are constructed as a single combined layer that is attached to the underside of the top layer 256, wherein the combined layer is or includes a metal, and wherein the slots 224 are carved into the combined metal layer. In some embodiments, the metal includes aluminum. In other embodiments, the metal includes steel.

In some embodiments, cone 230 is formed as part of middle section 240. In other embodiments, cone 230 is formed as part of top plate 256. In some embodiments, channels 224 are machined or otherwise formed into the top surface of bottom plate 236, and middle layer 240 is omitted. In other embodiments, channels 224 are formed into a top surface and/or a bottom surface of middle layer 240. In yet other embodiments, channels 224 are formed partly in one layer and partly in another layer.

The slots 124 extend radially outward to a point near the bowl inside wall 102 (see FIG. 1B) and similarly, the slots 224 extend radially outward to a point near the bowl inside wall 202 (see FIG. 2B). In some embodiments, the distance from the axis of rotation of the centrifuge bowl (101 or 201, respectively) to the end of a slot (124 or 224, respectively) is one hundred percent or less of the distance from the axis of rotation to the bowl inside wall (102 or 202, respectively). In some embodiments, the distance from the axis of rotation of the centrifuge bowl to the end of a slot is at least eighty percent of the distance from the axis of rotation to the bowl inside wall (e.g., the end of a slot (124 or 224) is one inch (2.54 cm.) from the bowl inside wall (102 or 202) when the bowl inside wall (102 or 202) is five inches (12.7 cm.) from the axis of rotation).

In some embodiments, the distance from the axis of rotation of the centrifuge bowl to the end of a slot is at least eighty-five percent of the distance from the axis of rotation to the bowl inside wall. In some embodiments, the distance from the axis of rotation of the centrifuge bowl to the end of a slot is at least ninety percent of the distance from the axis of rotation to the bowl inside wall. In some embodiments, the distance from the axis of rotation of the centrifuge bowl to the end of a slot is at least ninety-one percent of the distance from the axis of rotation to the bowl inside wall. In some embodiments, the distance from the axis of rotation of the centrifuge bowl to the end of a slot is at least ninety-two percent of the distance from the axis of rotation to the bowl inside wall. In some embodiments, the distance from the axis of rotation of the centrifuge bowl to the end of a slot is at least ninety-three percent of the distance from the axis of rotation to the bowl inside wall. In some embodiments, the distance from the axis of rotation of the centrifuge bowl to the end of a slot is at least ninety-four percent of the distance from the axis of rotation to the bowl inside wall. In some embodiments, the distance from the axis of rotation of the centrifuge bowl to the end of a slot is at least ninety-five percent of the distance from the axis of rotation to the bowl inside wall. In some embodiments, the distance from the axis of rotation of the centrifuge bowl to the end of a slot is at least ninety-six percent of the distance from the axis of rotation to the bowl inside wall. In some embodiments, the distance from the axis of rotation of the centrifuge bowl to the end of a slot is at least ninety-seven percent of the distance from the axis of rotation to the bowl inside wall. In some embodiments, the distance from the axis of rotation of the centrifuge bowl to the end of a slot is at least ninety-eight percent of the distance from the axis of rotation to the bowl inside wall. In some embodiments, the distance from the axis of rotation of the centrifuge bowl to the end of a slot is at least ninety-nine percent of the distance from the axis of rotation to the bowl inside wall.

In some embodiments, the distance from the axis of rotation of the centrifuge bowl 101 or 201 to the end of a slot 124 or 224 respectively is at least 99.1 percent of the distance from the axis of rotation to the bowl inside wall 102 or 202, respectively. In some embodiments, the distance from the axis of rotation of the centrifuge bowl to the end of a slot is at least 99.2 percent of the distance from the axis of rotation to the bowl inside wall. In some embodiments, the distance from the axis of rotation of the centrifuge bowl to the end of a slot is at least 99.3 percent of the distance from the axis of rotation to the bowl inside wall. In some embodiments, the distance from the axis of rotation of the centrifuge bowl to the end of a slot is at least 99.4 percent of the distance from the axis of rotation to the bowl inside wall. In some embodiments, the distance from the axis of rotation of the centrifuge bowl to the end of a slot is at least 99.5 percent of the distance from the axis of rotation to the bowl inside wall. In some embodiments, the distance from the axis of rotation of the centrifuge bowl to the end of a slot is at least 99.6 percent of the distance from the axis of rotation to the bowl inside wall. In some embodiments, the distance from the axis of rotation of the centrifuge bowl to the end of a slot is at least 99.7 percent of the distance from the axis of rotation to the bowl inside wall. In some embodiments, the distance from the axis of rotation of the centrifuge bowl to the end of a slot is at least 99.8 percent of the distance from the axis of rotation to the bowl inside wall. In some embodiments, the distance from the axis of rotation of the centrifuge bowl to the end of a slot is at least 99.9 percent of the distance from the axis of rotation to the bowl inside wall.

In some embodiments, the centrifuge 100 includes two radial slots 124 or 224. In some embodiments, the centrifuge 100 includes three radial slots. In some embodiments, the centrifuge 100 includes four radial slots. In some embodiments, the centrifuge 100 includes five radial slots. In some embodiments, the centrifuge 100 includes six radial slots. In some embodiments, the centrifuge 100 includes seven radial slots. In some embodiments, the centrifuge 100 includes eight radial slots. In some embodiments, the centrifuge 100 includes nine radial slots. In some embodiments, the centrifuge 100 includes ten radial slots. In some embodiments, the centrifuge 100 includes eleven radial slots. In some embodiments, the centrifuge 100 includes twelve radial slots. In some embodiments, the centrifuge 100 includes 13 radial slots. In some embodiments, the centrifuge 100 includes 14 radial slots. In some embodiments, the centrifuge 100 includes 15 radial slots. In some embodiments, the centrifuge 100 includes 16 radial slots. In some embodiments, the centrifuge 100 includes 17 radial slots. In some embodiments, the centrifuge 100 includes 18 radial slots. In some embodiments, the centrifuge 100 includes 19 radial slots. In some embodiments, the centrifuge 100 includes 20 radial slots. In some embodiments, the centrifuge 100 includes 21 radial slots. In some embodiments, the centrifuge 100 includes 22 radial slots. In some embodiments, the centrifuge 100 includes 23 radial slots. In some embodiments (as shown in FIG. 2B), the centrifuge 100 includes 24 radial slots. In some embodiments, the centrifuge 100 includes 25 radial slots. In some embodiments, the centrifuge 100 includes 26 radial slots. In some embodiments, the centrifuge 100 includes 27 radial slots. In some embodiments, the centrifuge 100 includes 28 radial slots. In some embodiments, the centrifuge 100 includes 29 radial slots. In some embodiments, the centrifuge 100 includes 30 radial slots. In some embodiments, the centrifuge 100 includes 31 radial slots. In some embodiments, the centrifuge 100 includes 32 radial slots. In some embodiments, the centrifuge 100 includes 33 radial slots. In some embodiments, the centrifuge 100 includes 34 radial slots. In some embodiments, the centrifuge 100 includes 35 radial slots. In some embodiments, the centrifuge 100 includes 36 radial slots. In some embodiments, the centrifuge 100 includes 37 radial slots. In some embodiments, the centrifuge 100 includes 38 radial slots. In some embodiments, the centrifuge 100 includes 39 radial slots. In some embodiments, the centrifuge 100 includes 40 radial slots. In some embodiments, the centrifuge 100 includes 41 radial slots. In some embodiments, the centrifuge 100 includes 42 radial slots. In some embodiments, the centrifuge 100 includes 43 radial slots. In some embodiments, the centrifuge 100 includes 44 radial slots. In some embodiments, the centrifuge 100 includes 45 radial slots. In some embodiments, the centrifuge 100 includes 46 radial slots. In some embodiments, the centrifuge 100 includes 47 radial slots. In some embodiments, the centrifuge 100 includes 48 radial slots. In some embodiments, the centrifuge 100 includes 49 radial slots. In some embodiments, the centrifuge 100 includes 50 radial slots. In some embodiments, the centrifuge 100 includes 51 radial slots. In some embodiments, the centrifuge 100 includes 52 radial slots. In some embodiments, the centrifuge 100 includes 53 radial slots. In some embodiments, the centrifuge 100 includes 54 radial slots. In some embodiments, the centrifuge 100 includes 55 radial slots. In some embodiments, the centrifuge 100 includes 56 radial slots. In some embodiments, the centrifuge 100 includes 57 radial slots. In some embodiments, the centrifuge 100 includes 58 radial slots. In some embodiments, the centrifuge 100 includes 59 radial slots. In some embodiments, the centrifuge 100 includes 60 radial slots. In some embodiments, the centrifuge 100 includes 61 radial slots. In some embodiments, the centrifuge 100 includes 62 radial slots. In some embodiments, the centrifuge 100 includes 63 radial slots. In some embodiments, the centrifuge 100 includes 64 radial slots. In some embodiments, centrifuge 100 includes more than sixty-four radial slots. In some embodiments, centrifuge 100 includes more than one hundred radial slots.

FIG. 2D is an enlarged perspective view of a portion the bottom of fluid-accelerating channel unit 240, according to some embodiments. In the embodiment shown, the three channels 224 that are shown here continue to the ends of the three ramps 226 that are shown here, and bottom plate 236 (see FIG. 2C) extends to inner lip 227 that extends between the sidewalls of adjacent ramps 226.

Figure 2E:
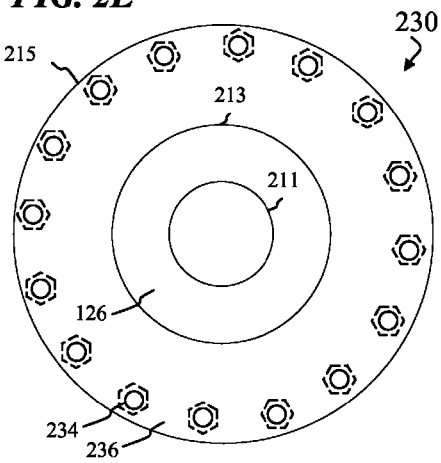
FIG. 2E is bottom view of alternative centrifuge bowl bottom plate 236.

FIG. 2E is bottom view of alternative centrifuge bowl bottom plate 236 and support ring 126 that together form bottom-plate assembly 230. Again, circle 211 represents the outer diameter of hub 105, circle 213 represents the outer wall of support ring 126, and circle 215 represents the outer edge of bottom plate 236. The bottom outlines of bolts 234 are shown.

Figure 2F:
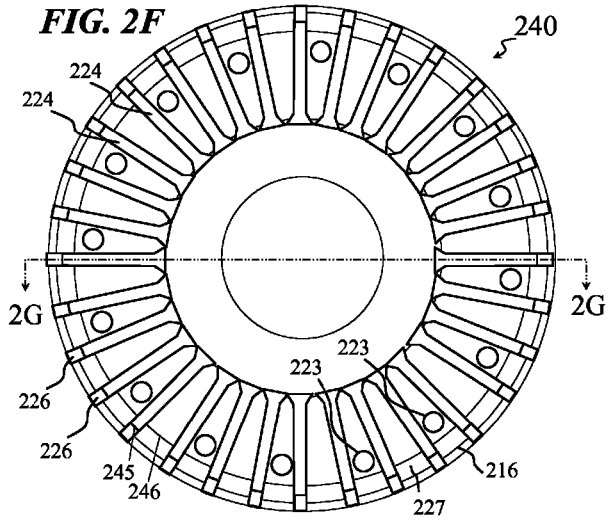
FIG. 2F is bottom view of alternative centrifuge bowl fluid-accelerating channel unit 240.

FIG. 2F is bottom view of alternative centrifuge bowl fluid-accelerating channel unit 240. The plurality of channels 224 end at ramps 226, with line 245 representing the intersection between channels 224 and ramps 226, and line 246 representing the intersection between the inner raised area separating adjacent channels 224 and inner lips 227. Holes 223 accommodate bolts 234 that clamp top plate 256 to bottom plate 236 (see FIG. 2B).

Figure 2G:
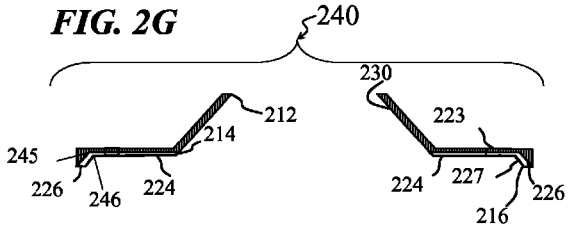
FIG. 2G is side cross-section view of alternative centrifuge bowl fluid-accelerating channel unit 240.

FIG. 2G is side cross-section view of alternative centrifuge bowl fluid-accelerating channel unit 240. The description from FIG. 2F applies to this figure. Upper inner rim 212 is the top edge of cone 230.

Figure 2H:
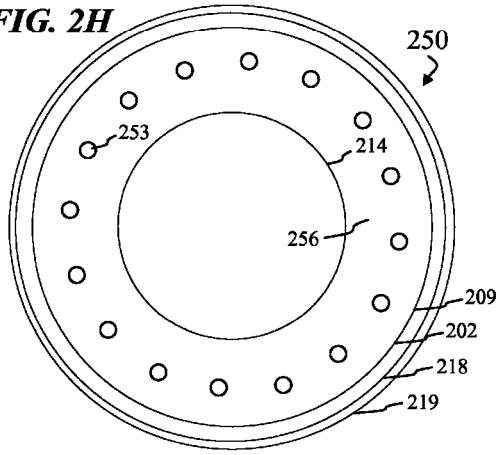
FIG. 2H is bottom view of alternative centrifuge bowl top plate 250 and bowl wall 202.

FIG. 2H is bottom view of alternative centrifuge bowl top plate assembly 250 having top plate 256 and bowl wall 209. The description from FIG. 2B applies to this figure.

Figure 2J:
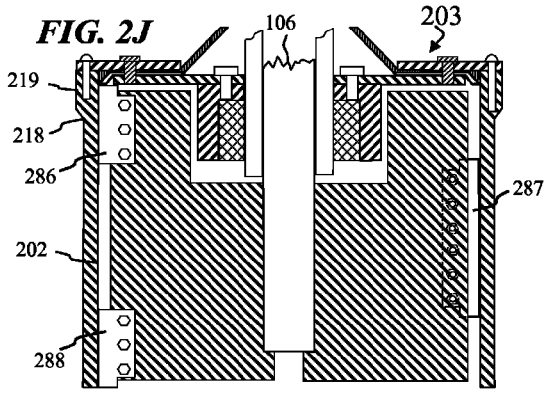
FIG. 2J is a cross-sectional view of one embodiment of a centrifuge bowl assembly 203.
Figure 2I:
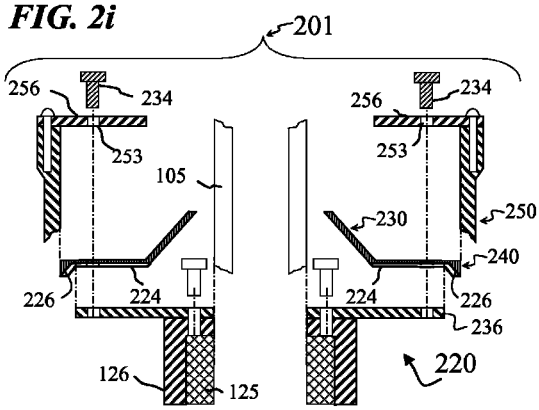
FIG. 2*i* is an exploded side cross-sectional view of the centrifuge bowl cover assembly 220.

FIG. 2*i* is an exploded side cross-sectional view of the centrifuge bowl cover assembly 220. The description from FIG. 2B also applies to this figure. This view illustrates how the bowl top assembly 250, the inlet cone assembly 240, the underside plate assembly 236, and the hub 105 all are connected together. In some embodiments, a plurality of bolts 234 connect the assemblies 236, 240, and 250 through a plurality of holes 223. In some embodiments, the slot 224 is extended substantially all the way to the bowl inside wall 102 via a slanted extension (ramp) 226.

FIG. 2J is a cross-sectional view of one embodiment of a centrifuge bowl assembly 203. In some embodiments, centrifuge bowl assembly 203 is similar to centrifuge bowl assembly 201 and 101 and the descriptions of FIG. 2B and FIG. 1B, except that rather than two full-length blades 181 as shown in FIG. 1B, a plurality of shorter blades are used. This reduces the force needed to rotate the blades and peel the accumulated cake, since moving two full-length blades through the cake require about twice the force needed for one blade. However, if one blade were used, there can be an out-of-balance condition (even when a counterweight is used) since some cake may stick to the blade after peeling the cake from the inner bowl wall 202. Accordingly, in some embodiments, a plurality of shorter blades is used, such that side-to-side balance and top-to-bottom balance are both maintained. In the embodiment shown, two short-length blades 286 (top left) and 288 (bottom left) (e.g., each being just over one-quarter the top-to-bottom length of wall 202) are used on one side (the left side in FIG. 2J), and one medium-length blade 287 (middle right) (e.g., being just over one-half the top-to-bottom length of wall 202, to provide a small amount of overlap with blades 286 and 288, which ensures a substantially complete peel of the cake) are used on the other side (the right side in FIG. 2J).

Figure 2K:
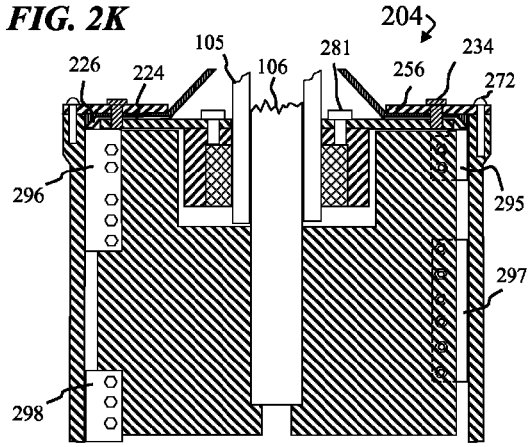
FIG. 2K is a cross-sectional view of another embodiment of a centrifuge bowl assembly 204.

FIG. 2K is a cross-sectional view of one embodiment of a centrifuge bowl assembly 204. In some embodiments, the fact that, in FIG. 2J, only blade 286 extends to the top of bowl wall 202, there can be more sliding material that accumulates on the left side than the right, which can lead to an out-of-balance condition, inefficient centrifuging, and vibration. To reduce this effect, centrifuge bowl assembly 204 also includes a short blade 295 at the upper right, and extends blade 296, such that to total amount of blade mass on the left equals that on the right, and also the top-to-bottom masses are balanced (the upper part of blade 296 equals blade 295 in mass, the lower part of blade 296 equals the upper half of blade 297 in mass, and lower left blade 298 equals the lower half of blade 297 in mass. This provides centrifuge balance when there is no extraneous material in centrifuge bowl assembly 204, as well as when there is some sliding material (material at the top that has moved around the circumference of inner wall 202 due to not being fully speed-matched to the wall 202) that has accumulated on blades 295 and 296.

In some embodiments, three or more peeler assemblies 103 are used (e.g., three peeler assemblies 103 spaced at one hundred-twenty degrees from one another, four peeler assemblies 103 spaced at ninety degrees, five peeler assemblies 103 spaced at seventy-two degrees, etc.). In some embodiments, each peeler assembly 103 includes one or more blades 181 (or 286, 287, 288, or 295, 296, 297, 298) that peel from an area of inner wall 102 or 202 that is not peeled by a blade of the other peeler assemblies 103. In some embodiments, helical peeler assemblies 103 are used having blade tips 180 that are not along a straight line, but rather curve in a helix around inner wall 102 or 202.

In some embodiments, the slots 224 are covered on their under side (e.g., by bottom plate 236, in some embodiments) to enclose the incoming fluid within each slot 224 and direct it to the bowl inside wall 102 and at the same time accelerate it to near the tangential speed of the wall 202 (see FIG. 2C). By accelerating the incoming fluid to substantially the same tangential speed as the rotating wall 202, the incoming fluid creates a minimal amount of turbulence as it strikes the wall 202 and flows downward through the centrifuge.

In some embodiments, the tangential speed of the incoming fluid passing through the radial slots 124 or 224 is eighty percent of the tangential speed of the bowl inside wall 102 or 202, respectively. In some embodiments, the tangential speed of the incoming fluid passing through the radial slots is eighty-five percent of the tangential speed of the bowl inside wall. In some embodiments, the tangential speed of the incoming fluid passing through the radial slots is ninety percent of the tangential speed of the bowl inside wall. In some embodiments, the tangential speed of the incoming fluid passing through the radial slots is ninety-one percent of the tangential speed of the bowl inside wall. In some embodiments, the tangential speed of the incoming fluid passing through the radial slots is ninety-two percent of the tangential speed of the bowl inside wall. In some embodiments, the tangential speed of the incoming fluid passing through the radial slots is ninety-three percent of the tangential speed of the bowl inside wall. In some embodiments, the tangential speed of the incoming fluid passing through the radial slots is ninety-four percent of the tangential speed of the bowl inside wall. In some embodiments, the tangential speed of the incoming fluid passing through the radial slots is ninety-five percent of the tangential speed of the bowl inside wall. In some embodiments, the tangential speed of the incoming fluid passing through the radial slots is ninety-six percent of the tangential speed of the bowl inside wall. In some embodiments, the tangential speed of the incoming fluid passing through the radial slots is ninety-seven percent of the tangential speed of the bowl inside wall. In some embodiments, the tangential speed of the incoming fluid passing through the radial slots is ninety-eight percent of the tangential speed of the bowl inside wall. In some embodiments, the tangential speed of the incoming fluid passing through the radial slots is ninety-nine percent of the tangential speed of the bowl inside wall.

In some embodiments, the tangential speed of the incoming fluid passing through the radial slots is 99.1 percent of the tangential speed of the bowl inside wall. In some embodiments, the tangential speed of the incoming fluid passing through the radial slots is 99.2 percent of the tangential speed of the bowl inside wall. In some embodiments, the tangential speed of the incoming fluid passing through the radial slots is 99.3 percent of the tangential speed of the bowl inside wall. In some embodiments, the tangential speed of the incoming fluid passing through the radial slots is 99.4 percent of the tangential speed of the bowl inside wall. In some embodiments, the tangential speed of the incoming fluid passing through the radial slots is 99.5 percent of the tangential speed of the bowl inside wall. In some embodiments, the tangential speed of the incoming fluid passing through the radial slots is 99.6 percent of the tangential speed of the bowl inside wall. In some embodiments, the tangential speed of the incoming fluid passing through the radial slots is 99.7 percent of the tangential speed of the bowl inside wall. In some embodiments, the tangential speed of the incoming fluid passing through the radial slots is 99.8 percent of the tangential speed of the bowl inside wall. In some embodiments, the tangential speed of the incoming fluid passing through the radial slots is 99.9 percent of the tangential speed of the bowl inside wall.

Figure 3A:
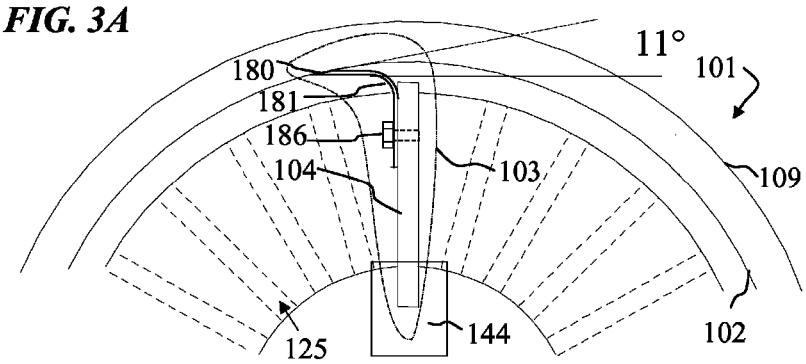
FIG. 3A is an enlarged bottom view of a portion of the inside of centrifuge bowl assembly 101.

FIG. 3A is an enlarged view of the bottom portion of the inside of the centrifuge bowl 101 (also, see the description of FIG. 1A above). In some embodiments, each one of the plurality of peeler assemblies 103 includes a blade-arm mounting device 104 and a blade 181. In some embodiments, the blade tip 180 of blade 181 is aligned at an angle of substantially eleven degrees relative to the inside wall 102 of the centrifuge bowl 101. In some embodiments, the angle from the inside face (the face facing toward the cake when scraping) of blade 181 to the tangent of the bowl wall 102 is 11 degrees. In some embodiments, the angle from the inside face of blade 181 to the tangent of the bowl wall 102 is between 9 degrees and 13 degrees. In other embodiments, the angle is 3 degrees, 4, degrees, 5 degrees, 6 degrees, 7 degrees, 8 degrees, 9 degrees, 10 degrees, 12 degrees, 13 degrees, 14 degrees, 15 degrees, 16 degrees, 17 degrees, 18 degrees, 19 degrees, 20 degrees, 22 degrees, 24 degrees, 26 degrees, 28 degrees, 30 degrees or 30-45 degrees. In some embodiments, the eleven-degree alignment provides an optimal angle for peeling the accumulated solids off of the inside wall 102. In some embodiments this angle may be determined empirically by measuring the force needed to move the blade through accumulated cake, and adjusting the angle to various angles to achieve a minimum force for the particular type of cake material. When the angle is made smaller (i.e., more level), the blade tip 180 tends to skip over the solids. On the other hand, when the angle is made larger (i.e., steeper), the blade tip 180 tends to dig into the bowl 101, causing damage to both the bowl 101 and the blade tip 180.

Figure 3B:
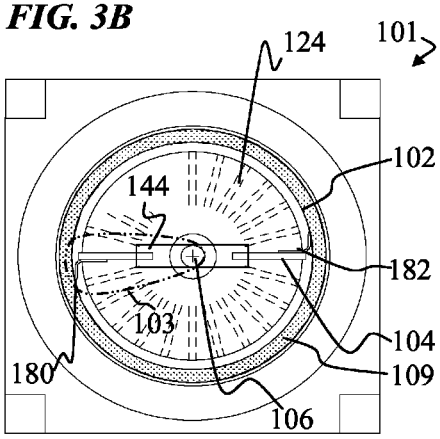
FIG. 3B is a bottom view of centrifuge bowl 101.

FIG. 3B is a bottom view of centrifuge bowl 101. In some embodiments, blade shaft 106 holds a middle plate 144, which in turn holds two outer plates of mounting device 104, one to each side, and these in turn hold two blades 181 having inside corners 182 and tips 180. Mounting device 104 and blades 181 form peeler assembly 103. The plurality of fluid-accelerating channels 124 tangentially accelerate the incoming fluid, in order to reduce turbulence in the fluid as the fluid first contacts inner wall 102 (or as the fluid first contacts the solids already accumulated on inner wall 102).

Figure 3C:
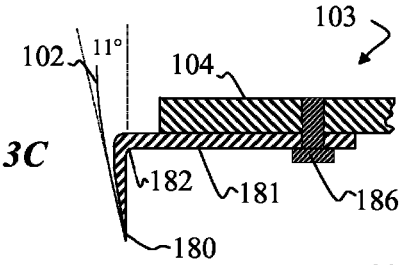
FIG. 3C is a cross-sectional view of one embodiment of a peeler assembly 103.

FIG. 3C is a cross-sectional view of one embodiment of a peeler assembly 103. In some embodiments, the blade 181 includes a corner section 182 that forms a substantially ninety-degree angle with respect to the mounting device 104. During the peeling of collected solids from the inside wall 102, some solids may compact into this corner section 182 and therefore decrease the efficiency of the peeling process.

Figure 3D:
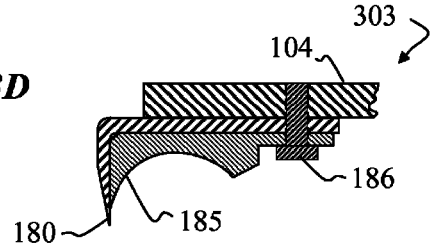
FIG. 3D is a cross-sectional view of another embodiment of a peeler assembly 303.

FIG. 3D is a cross-sectional view of another embodiment of a peeler assembly 303. In some embodiments, in order to avoid the compacting of solids into this location, the blade 181 includes a curved curling piece 185 that attaches to the corner section 182 of the blade 181 and operates to curl the cake after the cake is peeled from inner wall 102 or 202. The curved curling piece ensures that the solids peel off of the inside wall 102 in a continuous curl, thereby preventing solids buildup in the corner section 182 of the blade 181 (this can also reduce the force needed to move the peeling blades 181, since cake that piles up in corner 182 could otherwise increase the force needed to move the blades 181. In some embodiments, the curved curling piece 185 is detachable from the blade 181. In some embodiments, the curved curling piece 185 is attached on top of blade 181 by bolt 186. In other embodiments, the curved curling piece 185 snaps into place via notches that are formed in the corner section 182 of the blade 181. In some embodiments, the curved curling piece includes a center of mass that is located (e.g., located close to the radial portion of blade 181 next to attachment plate 104) such that the piece stays snapped in place during operation of the centrifuge 100. In some embodiments, the curved curling piece is plastic or includes a plastic material.

In some embodiments, each blade 181 is attached to the mounting device 104 with one or more bolts 186. In some embodiments, in order to maintain the balance of the centrifuge, the same number of and size of bolts are used to attach each blade 181 (or set of blades such as 288 and 286, versus blade 287) to its respective mounting device 104. In some embodiments, the one or more bolts rise above the surface of the blade 181, and therefore, during the peeling process, solids can compact on the backside of the one or more bolts (i.e., the side of the one or more bolts closest to the corner section of the blade 181). In some embodiments, the curved curling section 185 is designed such that the compacting of solids on the backside of the one or more bolts is avoided, in addition to preventing solids from compacting in the corner section of the blade 181. In some embodiments, the compacting of solids onto bolts 286 is avoided by using one or more bolts 186 that are recessed into the blade 181 surface such that the tops of the one or more bolts are flush with the surface of the blade 181. In other embodiments, carriage bolts having shallow curve heads with little if any edge are used.

In some embodiments, two peeler assemblies 103 are preferred for symmetry and to reduce or avoid an out-of-balance condition if a small amount of solid material sticks to both blades after peeling (see FIG. 1B and FIG. 3B). In some embodiments, only one peeler assembly 103 is provided and this peeler assembly 103 is balanced by a counter-weight on an opposite side of shaft 106. The use of two peeler assemblies 103 is generally preferred because solids tend to build-up on the scraper blades 181 of the centrifuge bowl 101 during centrifugal rotation of bowl 101, and this build-up of solids can affect the balance of the bowl 101 and the balance of the peeler assemblies 103 themselves. For instance, if two peeler assemblies 103 are used, solids will build-up on the peeler assemblies 103 at substantially the same rate, and therefore, the peeler assemblies 103 will remain balanced throughout centrifuging. In addition, when the bowl 101 and peeler assemblies 103 are stopped for peeling, the solids built-up on the peeler assemblies 103 during the peeling operation will presumably fall off of the peeler assemblies 103 at the same rate, and therefore, the peeler assemblies 103 will be balanced for the start of the peeling process. In contrast, if only one peeler assembly 103 is used and this peeler assembly 103 is balanced by a counterweight having a different type of surface, the solids may build up on this counterweight at a rate different from the build-up rate on the peeler assembly 103, thereby leading to unbalance of the bowl assembly 101 during centrifugal rotation.

In some embodiments, each peeler assembly 103 includes a non-stick surface. The use of a non-stick surface minimizes the build-up of solids on the peeler assemblies 103 during the centrifugal rotation of the bowl 101 and during the peeling process. In some embodiments, a peeler assembly 103 includes non-stick Teflon®, at least on some surfaces.

Figure 4:
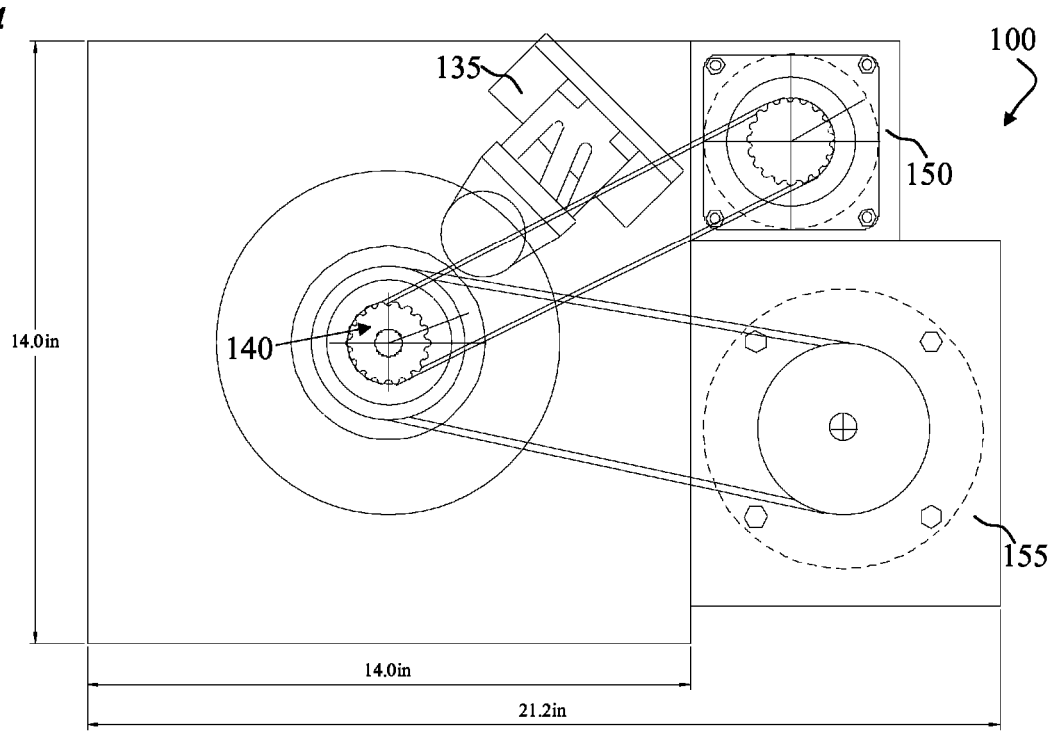
FIG. 4 is a top view of the mechanical systems of centrifuge 100.

FIG. 4 is a top view of the centrifuge 100 mechanical systems 400. In some embodiments, the bowl motor drive 155 powers the rotation of the bowl 101 via a mechanical belt. In some embodiments, the blade motor drive 150 connects to the tooth clutch 140 via a mechanical belt.

In some embodiments, the braking means 135 includes a brake disk and a plurality of calipers. In other embodiments, the braking means 135 also includes a locking mechanism which helps to hold the bowl 101 in position during scraping. In some embodiments, the locking mechanism includes a drop-in pin 136 that locks into the brake disk during operation of the braking means 135. In some embodiments, the pin is connected to an electromagnet and/or a spring that operate or cooperate to insert the pin into one or one or more holes in the brake disk to stop the disk and bowl 101 from moving in the case where the disk brake alone is insufficient to hold without slipping during operation of the peeling process. In some embodiments, the motor drive 155 is shut off during the peeling process.

In some embodiments, the present invention provides a control module 555 to control the centrifuging process and the peeling (also called scraping) process.

In some embodiments, the present invention provides a centrifuge apparatus for substantially separating dry solids from a slurry or similarly flowable material such as a fluid containing particles, wherein the centrifuge apparatus includes: a centrifuge bowl, wherein the bowl includes a cylindrical inner surface and an open bottom, and wherein the bowl is configured to rotate around a vertical hub, a bowl cover connected to a top of the centrifuge bowl, an inward-slanting cone (i.e., a cone section with a narrow opening at the top and wide outlet at the bottom) fastened to an upper surface of the bowl cover, the inward-slanting cone positioned at a center of the bowl cover and configured to rotate with the bowl, wherein a plurality of small inlet holes through the bowl cover are positioned at a maximum inside diameter of the cone such that an incoming liquid entering the cone during rotation will immediately pass through the bowl cover without time to deposit solids on an inside surface of the cone, a plurality of inlet ducts, wherein the plurality of inlet ducts are configured to direct the incoming liquid into the inward-slanting cone, a plurality of radial passages, each one of the plurality of radial passages connected to a corresponding one of the plurality of inlet holes, wherein the plurality of radial passages extend radially outward from the plurality of inlet holes such that the incoming liquid is distributed uniformly around an upper portion of an inner wall of the bowl at a first rotational speed, and wherein the first rotational speed is substantially equivalent to a second rotational speed of the inner wall, a collection trough located around a perimeter of a bottom of the centrifuge bowl, wherein the collection trough collects a centrifuged liquid that flows out of the bottom of the centrifuge bowl, a plurality of scraper blades located inside the centrifuge bowl, wherein the plurality of scraper blades are configured to peel a solids layer from the inner wall of the bowl, and wherein the solids layer collects on the inner wall during operation of the centrifuge, a plurality of pumps operatively coupled to the plurality of inlet ducts, wherein the plurality of pumps are configured to push the incoming liquid through the centrifuge, a first drive motor operatively coupled to the centrifuge bowl, wherein the first drive motor provides power to rotate the bowl, a second drive motor operatively coupled to the plurality of scraper blades, wherein the second drive motor provides power to rotate the plurality of scraper blades around the inner wall of the bowl, a brake device operatively coupled to the centrifuge bowl, wherein the brake device is configured to stop the bowl from rotating during scraping, and a control module operatively coupled to the first drive motor, the second drive motor, the brake device, and the plurality of pumps, wherein the control module is configured to control the operation of the centrifuge.

In some embodiments, the inward-slanting cone slants inwards at an angle of thirty to sixty degrees relative to the vertical hub. In some embodiments, the inward-slanting cone slants inwards at an angle of forty-five degrees relative to the vertical hub.

In some embodiments, the plurality of radial passages extends radially outward to a point one-half inch (1.27 cm.) away from the inner wall of the centrifuge bowl. In some embodiments, the plurality of radial passages extends radially outward to a point one-quarter inch (0.635 cm.) away from the inner wall of the centrifuge bowl.

In some embodiments, the present invention provides a thin cover section, wherein the thin cover section covers the plurality of inlet holes, and wherein the thin cover section prevents collection of liquid-borne particles within the plurality of inlet holes. In some embodiments, each one of the plurality of inlet holes includes a chamfered underside, wherein the chamfered underside prevents collection of liquid-borne particles within the plurality of inlet holes.

In some embodiments, each one of the plurality of scraper blades is aligned at an angle of eleven degrees relative to the inner wall of the centrifuge drum. In some embodiments, each one of the plurality of scraper blades has a blade height equivalent to a height of the inner wall of the centrifuge drum, wherein the plurality of scraper blades includes a first blade located at a first radial location along the inner wall and a second blade located at a second radial location along the inner wall, and wherein the second radial location is one hundred and eighty degrees away from the first radial location.

In some embodiments, each one of the plurality of scraper blades has a blade height equivalent to one-half of a height of the inner wall of the centrifuge drum, wherein the plurality of scraper blades includes a first scraper blade located at a first radial location along the inner wall and a second scraper blade located at a second radial location along the inner wall, the second radial location situated one hundred and eighty degrees away from the first radial location, and wherein the first scraper blade is positioned at an upper half of the inner wall, and wherein the second scraper blade is positioned at a lower half of the inner wall.

In some embodiments, each one of the plurality of scraper blades has a blade height equivalent to one-third of a height of the inner wall of the centrifuge drum, wherein the plurality of scraper blades includes a first scraper blade located at a first radial location along the inner wall and positioned at an upper third of the inner wall, a second scraper blade located at the first radial location and positioned at a lower third of the inner wall, and a third scraper blade located at a second radial location and positioned at a middle third of the inner wall, and wherein the first radial location is one hundred and eighty degrees away from the second radial location.

In some embodiments, the plurality of scraper blades includes a first blade located at a first location along the inner wall of the centrifuge drum, wherein the first blade has a blade height equivalent to a height of the inner wall of the centrifuge drum, and wherein the plurality of scraper blades includes a counter-weight, and wherein the counter-weight includes a size and a location such that a mass of the first blade is balanced by the counter-weight.

In some embodiments, the brake device includes a brake disk and one or more calipers, wherein all of the plurality of calipers clamps down on the brake disk during operation of the brake device. In some embodiments, the brake device further includes a locking mechanism, wherein the locking mechanism locks into place during operation of the brake device such that the centrifuge bowl is held in position.

Operation

Separation mode: In some embodiments, the present invention provides a method that includes rotating the bowl 101 or 201 at a predetermined speed, feeding particle-laden liquid to the inlet cone 115 that feeds the particle-laden liquid to the radial slots 124 or 224, and directing the liquid through the radial slots 124 or 224 towards the bowl inside wall 102 or 202. In some embodiments, during the passage through the radial slots 124 or 224 the liquid is accelerated to a tangential velocity close to the tangential velocity of the bowl inside wall 102. Because of the large number of radial slots 124 or 224, the liquid is quite evenly distributed around the top of the bowl inside wall 102 with a speed close to that of the wall 102. This minimizes any slippage (also called sliding) of liquid and resulting impact of the scraper blades 181 on the incoming liquid (which can cause an out-of-balance condition and/or rivulets (streaming) of the liquid next to the blades 181.

In some embodiments, the method further includes flowing the fluid downward as a thin film of liquid over the bowl inside wall 102, and spilling the fluid over the lower edge of the bowl 101 to the collection trough 122 and then to the outlet port. During its passage over the bowl inside wall 102, particles are separated from the liquid by centrifugal force and deposited on the bowl inside wall 102. In some embodiments, additional incoming liquid will then flow over the layer of solids previously deposited on the bowl inside wall 102.

Observation of the operation and separation process was made in the initial prototype of one embodiment of the centrifuge with the aid of a strobe. This prototype lacked the improved design features of other embodiments. For example, only eight slots were used and each slot ended ½ inch (1.27 cm.) from the bowl wall. These observations showed a gradual accumulation of a uniform layer of particles on the inner surface of the bowl wall. This uniform build up of particles continued for a time and then become less and less uniform due to three factors:

1. Larger particles (e.g., 5 microns (micrometers) and larger) were deposited on the upper portion of the bowl at the slot exits and accumulated as small mounds of solids. These mounds probably affected the uniformity of later incoming liquid;

2. Because the tangential velocity of the incoming liquid lags somewhat, the velocity of the liquid is impacted by the scraper blades, which causes some non-uniformity in the flow distribution (e.g., the incoming liquid traveling through the slot is brought close to the tangential speed of the inner surface of the bowl wall, but since the bowl wall is moving at a somewhat faster tangential speed, the incoming liquid will briefly slide along the wall in an angular direction before matching the tangential speed of the wall and beginning to flow downwards along the wall—if there is a scraper blade near the exit of the slot, the incoming liquid will contact the blade during the brief angular movement and solids from the incoming liquid will accumulate on the blade, and this accumulation will build inwards toward the rotational axis of the centrifuge where there is less centrifugal force, and therefore less separation);

3. Some out-of-balance conditions of the prototype bowl assembly resulted in vibration that is believed to negatively effect flow distribution and separation of particles. Therefore, keeping the centrifuge bowl balanced by using peeler assemblies and scraper blades that each accumulate an approximately equal amount of solids on their surface is an important aspect of the present invention (see the above discussions relating to FIG. 2J, FIG. 2K, and FIG. 3D).

Peeling Mode (Also Called Scraping Mode)

In some embodiments, the method further includes peeling (also called scraping) the solids off of the bowl inside wall 102. In some embodiments, to initiate the scraping or peeling of solids, the plurality of feed pumps 111 supplying incoming flow is shut off. In some embodiments, a predetermined time (in some embodiments, for example, 5 to 20 seconds) of continued spinning is allowed before stopping the bowl and engaging the peeling process. This time delay allows further draining of liquid from the solids cake surface and results in dryer solids. In some embodiments, following the time delay, the motor drive 155 is shut off and the braking means 135 is activated to stop the rotating bowl 101 and hold it stationary during the scraping process. In some embodiments, to begin the scraping of solids a tooth clutch 140 is activated which allows blade motor drive 150 to drive the peeler assemblies 103 in a direction so as to cause peeling of the solids from the bowl inside wall 102. In some embodiments, the dislodged solids fall through the open bottom of the bowl 101 to a solids receptacle positioned below the centrifuge. In some embodiments, the braking means 135 and tooth clutch 140 are then released and the motor drive 155 and pumps 111 are restarted and the separation process begins again.

In some embodiments, the bowl (109 or 209) is made with no lip at its lower end, as shown in the figures and described in the above description, in order that substantially all liquid can be spun out of the accumulated solids. This provides the ability to obtain very dry cake, since once the flow of fluid into the bowl stops, the centrifuge forces and/or air drying will remove just about as much liquid from the cake as the operator wishes (with the caveat that over-drying may lead to dust in the air when very dry cake is peeled from the bowl). However, in some cases, it is desirable to provide a small (e.g., 0.1 to 3 mm; in various such embodiments, this lip is 0.1 mm, 0.2 mm, 0.5 mm, 1.0 mm, 1.5 mm, 2 mm, 2.5 mm, 3 mm, or larger than 3 mm on a bowl having a 250 mm inside diameter, in other embodiments, lips having similar percentages of the bowl diameter are used for other sizes of bowls) inward lip on the bowl's bottom rim, in order to build up a small even thickness of solids, which provides a smoother more even flow later in the centrifuging cycle. In other embodiments, a similar-sized lip is provided, and one or more slits and/or holes are cut in the lip and/or lower edge of the bowl to allow initial buildup of the even layer, while later allowing spin drying to remove substantially all liquid through the slit(s) or hole(s). In some embodiments, these slit(s) or hole(s) may clog with solids, but this may be acceptable in some embodiments, or these slit(s) or hole(s) may be cleaned periodically manually.

Applications

The dry-solids centrifuge 100 is well suited for applications involving low flow rates, e.g., below ten gallons per minute (GPM), and high solids content, e.g., above one-tenth percent or particularly above one percent. This class of applications includes replacing and/or supplementing filtration, dewatering and/or clarification of a waste stream (e.g., the separation of particles from the underflow stream of hydrocyclone systems, filtration of the waste stream from vibratory finishing machines, and side-stream separation of fines that accumulate in industrial fluid-processing systems). This class of applications also includes the clarification of the waste stream from slurry discharges from other concentrating devices such as self-cleaning centrifuges, back-flush filters and settling tanks. Any other suitable type of system for pre-concentrating particulates from a liquid (such as settling tanks, where the settled particulates and bottom layer of fluid are periodically pumped from the bottom of the tank and into centrifuge 100) is also well suited for combination with the dry-solids separation function of the present invention.

Vibratory finishing machines produce a low-flow waste stream with a high concentration of fine particles. Flow rates from vibratory finishing machines are generally less than one GPM. Solids concentrations are in the two-to-five-percent range. In some embodiments, the dry-solids centrifuge 100 can separate a high percentage of these solids leaving only a small percentage of the particles, so that the waste stream is less burdensome to other post-treatment systems or the environment or often may be recycled for reuse. Vibratory finishers debur and finish metal parts by exposing the parts to a vibrating mass of loose media (e.g., ceramic, plastic or steel pellets or balls). Water (or other suitable solvent such as alcohol or other polar solvent, or a non-polar organic solvent), optionally also containing a mixture or one or more compounds (such as a detergent) designed to aid the cleaning, burnishing and polishing of parts, is continuously fed to the media. This liquid stream washes away the particles resulting from wear of the media and finishing of parts and leaves the finisher as a waste stream. The dry-solids centrifuge of the present invention removes the particles from the waste stream and discharges the collected particles as substantially dry solids, often allowing the water (or other solvent) and the valuable compounds to be recycled to the finisher. This provides the dual benefit of minimizing waste disposal (waste material in near dry state) and conserving fluid and valuable compounds.

A hydrocyclone is a static cone-shaped device with a tangential inlet that utilizes the fluid pressure of the incoming fluid stream to generate a vortex for the separation of solid particles. The separated particles are entrained in a small fluid stream called the underflow and carried out the bottom of the hydrocyclone, while the clarified fluid exits the top. Hydrocyclones are capable of concentrating dilute suspensions of particles from a large flow stream into a small portion, e.g., one or five percent, of the flow stream, which is called the underflow. The underflow stream is generally passed through a settling tank to remove particles so that the fluid can be returned to the process. This underflow separation system is usually inefficient (i.e., a weak link) of a hydrocyclone system, because settling tanks are generally less efficient than is required or desired in many applications.

The dry-solids centrifuge of the present invention can improve the performance of hydrocyclone systems in two ways. First the dry-solids centrifuge will remove substantially all of the particles for which the hydrocyclone is effective so that none of the particles separated by the hydrocyclone will return to the process. Secondly, the dry-solids centrifuge can separate finer particles than the hydrocyclone is capable of removing. This provides a side-stream filtration of these very fine particles, preventing their concentration from building up to intolerable levels. In addition, the dry-solids centrifuge will discharge the separated solids in a nearly dry state for ease of handling and disposal.

Unique Dual-Centrifuge System

Figure 5:
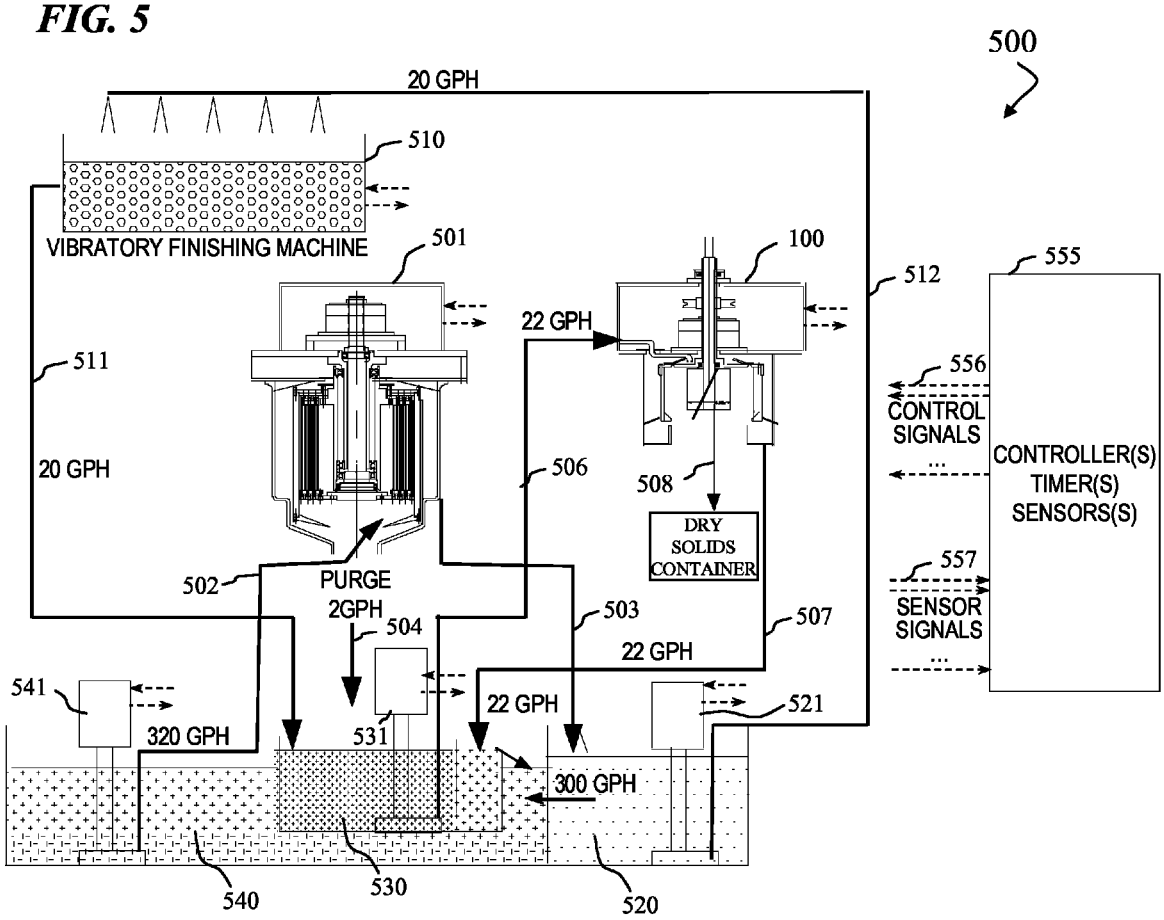
FIG. 5 is a schematic diagram of a dual centrifuge system 500 that includes the dry-solids centrifuge 100.

FIG. 5 is a schematic of this unique use of the dry-solids centrifuge 100 in combination with a high-efficiency centrifuge 501. In some embodiments, the dry-solids centrifuge 100 of the present invention operated synergistically with, and enhances the performance of, the high-efficiency centrifuge 501, (for example one such as that disclosed in U.S. Pat.

No. 7,077,799), by providing simultaneous pre-cleaning fluid 540 that is then further cleaned by high-efficiency centrifuge 501, and post treatment of vibratory finishing waste stream 511 to reduce the amount of waste to just the dry solids 508. In some embodiments, the dry-solids centrifuge 100 provides pre-cleaning of vibratory finishing machine waste stream 511 prior to treatment by the high-efficiency centrifuge 501 and post treatment of the discharged slurry 504 from the high-efficiency centrifuge 501. The flow rates shown in FIG. 5 are representative of a typical vibratory-finishing machine 510 and are presented here as an example of the dual-centrifuge system 500 (note that in some embodiments, as shown in FIG. 5, feed pumps 521, 531, and 541 provide the necessary flow rates). This unique combination can be applied to vibratory finishing machines 510 with either higher or lower flows. In some embodiments, the vibratory-finishing machine 510 is supplied with an inlet stream 512 that comes from a feed tank 520.

In some embodiments, an electronic controller 555 (e.g., such as a programmable logic controller (PLC)) is used to generate control signals 556 that control centrifuge 100, high-efficiency centrifuge 501, and pumps 521, 531 and 541 through the use of appropriate actuators, relays, electronic switches, and the like, e.g., to control air flow (e.g., through air inlet tubing 112 (see FIG. 1A)) to tooth clutch 140 and the caliper of brake 135, to control the connection of electricity to motors 150 and 155, and/or other mechanisms of centrifuge 100. In some embodiments, one or more sensors connected to the electronic controller collect data (such as weight (that might indicate that sufficient solids had been collected), the amount of vibration or acoustic noise (that might indicate an out-of-balance condition), the amount of liquid leaving the centrifuge bowl 101 (that would indicate when the solids had been sufficiently spin-dried (after the cessation of fluid input to centrifuge bowl 101) to allow pealing of the dry solids), the fluid levels or flow rates (for input and/or output fluids) or other parameters that may be needed to assist in efficient automatic control of centrifuge 100).

In some embodiments, the dry-solids centrifuge 100 operates as a pre-cleaner by separating most of the coarse particles and a small percentage of the fine particles prior to the inlet stream 502 (which comes from feed tank 540) entering the high efficiency centrifuge 501 (in some embodiments, the coarse and fine particles are discharged by centrifuge 100 as dry solids 508, while the remaining liquid is discharged by centrifuge 100 as outlet stream 507). In some embodiments, the high efficiency centrifuge 501 separates essentially all of the liquid borne particles from a vibratory finishing machine waste stream 511 (resulting in a clarified liquid stream 503), and periodically self-cleans itself of collected particles by discharging collected solids in the form of liquid slurry 504. However, the larger particles, e.g., larger than 5 microns, present in the waste stream 511 cause premature loading of its collection surfaces resulting in the need for more frequent purging of solids. Without a pre-cleaner to remove these larger particles, purging of the centrifuge 501 could be required as often as every 15 minutes. In some embodiments, use of the dry-solids centrifuge 100 as a pre-cleaner of the waste stream 511 can extend the purge interval up to two hours.

In other embodiments, the centrifuge 100 can be used to pre-clean some lesser portion of the inlet stream 502 going to the high efficiency centrifuge 501. In some embodiments, the flow percentage would be adjusted to remove sufficient coarse particles to give acceptable purge frequency.

In some embodiments, as can be seen from FIG. 5, the dry-solids centrifuge 100 also provides post treatment of the discharged slurry 504 from the high efficiency centrifuge 501. In some embodiments, particles removed by the high efficiency centrifuge 501 are periodically discharged from the high efficiency centrifuge 501 in the form of slurry 504 (in some embodiments, slurry 504 has a flow rate of about 1.5 gallons per hour). In some embodiments, this slurry 504 is returned to the feed tank 530 for the dry-solids centrifuge 100 where it mixes with the incoming waste stream 511 from the vibratory finishing machine 510. In some embodiments, the addition of the discharge slurry 504 to the waste stream 511 increases the inlet stream 506 to the dry-solids centrifuge 100 by about five percent. The flow rates depicted in FIG. 5 are higher than required to account for any variation in flows, and to provide some recirculation within the system 500. Particles within the slurry 504 represent the smallest particles of the original waste stream 511, because the coarser particles were removed by the dry-solids centrifuge 100 prior to entering the high efficiency centrifuge 501. In some embodiments, as these small particles pass through the dry-solids centrifuge 100 a second time, a small percentage (e.g., ten percent) will be separated and discharged with the larger particulate as dry solids 508. In some embodiments, the separation can actually be much higher than predicted theoretically as many of the fine particles separated by the high efficiency centrifuge 501 are not totally dispersed during the purge and are discharged as agglomerates that are more easily separated by the dry-solids centrifuge 100 than they were originally.

In some embodiments, centrifuge 100 or system 500 is scaled to a larger size, and is used to dry solids from such waste streams as sewage or industrial waste and to clarify the liquid for further treatment by chemical, enzyme and/or biological methods.

In some embodiments, centrifuge 100 or system 500 is scaled to a larger size, and is used (e.g., as a replacement for sub-micron ceramic filters) to separate liquid or dissolved solid components from a liquid stream. In some embodiments, one or more centrifuges 100 and/or 500 are used to separate the liquid resulting from ethanol fermentation, first to remove the visible or invisible solids (distiller's grain) from the liquid, and/or second to concentrate the alcohol (e.g., separate a liquid having increased water concentration from a liquid having increased alcohol content, as a substitute or supplement for distilling) for further treatment by chemical, enzyme and/or biological methods.

In other embodiments, other uses for the present invention include removing solids (such as metal, carbon, or other impurities) from used vehicular motor oil, transmission fluid, or antifreeze, or from food-processing streams such as cooking-oil or cooking-water wastes or cheese-making whey. In some embodiments, the present invention provides a way to lengthen the life (by pre-removing at least some of the yeast) of sub-micron ceramic filters that are used instead of Pasteurization to remove yeast or other biological material from streams such as cold-filtered beer or wine. In yet other embodiments, the present invention provides a way to separate or purify components from a mixture of fluids, such as gasoline from ethanol, or water from used automobile antifreeze, or proteins from whey. In yet other embodiments, the present invention provides a way to further separate, dry or purify components that have been pre-concentrated by a process such as boiling or freeze-drying, such as processing dried soups, dried milk, instant coffee or mashed potatoes.

In some embodiments, the unremoved fine particles pass on to the high efficiency centrifuge 501 where they are removed again. In some embodiments, this results in a build up in the concentration of these fine particles in the inlet stream 502 entering the high efficiency centrifuge 501 to a level several times their original concentration. But this causes no harm as these particles represented a small percentage of the original waste stream particles.

In some embodiments, the present invention provides a centrifuge apparatus for extracting solids from an incoming particle-laden fluid. This apparatus includes a centrifuge bowl, wherein the bowl includes a cylindrical inner-wall surface and an open bottom, and wherein the bowl is configured to rotate around an axis of rotation, and wherein the bowl includes a bowl cover connected to a top of the centrifuge bowl, a particle-laden-fluid catcher fastened to an upper surface of the bowl cover, the fluid catcher having a smaller upper opening and a larger lower portion, the fluid catcher centered around the axis of rotation of the bowl, one or more inlet ducts, wherein the one or more inlet ducts are configured to direct the incoming particle-laden fluid into the particle-laden-fluid catcher, a plurality of radial passages each having in inner end and an outer end, each one of the plurality of radial passages configured to receive the particle-laden-fluid at its inner end, and to extend radially outward such that the incoming particle-laden-fluid as it travels through the plurality of radial passages is rotationally accelerated to a first rotational speed and is distributed substantially uniformly around an upper portion of the inner-wall surface of the bowl at the first rotational speed, and wherein the first rotational speed is close to a second rotational speed of the inner-wall surface, wherein a layer of solids from the particle-laden-fluid collects on the inner-wall surface of the bowl during operation of the apparatus, a fluid collection trough located around a perimeter of the open bottom of the centrifuge bowl and outside a cylinder defined by and extending from the open bottom of the centrifuge bowl, wherein the collection trough collects a centrifuged liquid that flows out of the bottom of the centrifuge bowl, one or more scraper blades located inside the centrifuge bowl, wherein the one or more scraper blades are configured to peel a layer of solids from the inner-wall surface of the bowl, and a first drive mechanism operatively coupled to the centrifuge bowl, wherein the first drive mechanism operates to rotate the bowl in a centrifuge motion, a second drive mechanism operatively coupled to the one or more scraper blades, wherein the second drive mechanism provides power to rotate the one or more scraper blades around the inner-wall surface of the bowl, and a slowing device operatively coupled to the centrifuge bowl, wherein the slowing device is configured to slow the bowl from its centrifugal motion and hold the bowl in a substantially stopped position such that the scraper blades can peel the layer of solids from the bowl.

Some embodiments of the apparatus further include a stand, wherein the slowing device includes a disk brake having a brake disk in a fixed relationship to the bowl and a caliper operatively coupled to the stand.

In some embodiments, the slowing device includes a disk brake operable to slow the bowl from its centrifugal motion and a locking mechanism operable to hold the bowl in a substantially stopped position while the scraper blades peel the layer of solids from the bowl.

In some embodiments, first drive mechanism includes a motor and a belt drive, and the second drive mechanism includes a motor and a chain drive.

Some embodiments further include a plurality of pumps operatively coupled to the one or more inlet ducts, wherein the plurality of pumps are configured to push the incoming liquid through the centrifuge, and a control module operatively coupled to the first drive mechanism, the second drive mechanism, the slowing device, and the plurality of pumps, wherein the control module is configured to automatically control the operation of the centrifuge, and wherein the operation of the centrifuge includes a centrifuge mode interleaved with a peeling mode.

In some embodiments, the bowl cover includes a plurality of inlet holes through the bowl cover that are positioned at a maximum inside diameter of the particle-laden-fluid catcher, and wherein each one of the plurality of inlet holes connects to a corresponding one of the plurality of radial passages, and wherein the particle-laden-fluid catcher is shaped as a section of a cone such that an incoming liquid entering the cone during rotation will flow to the larger-diameter lowest end of the cone and pass through the inlet holes in the bowl cover without depositing solids on an inside surface of the particle-laden-fluid catcher.

In some embodiments, the bowl cover includes a first layer, a second layer, and a third layer, and wherein the second layer is located in between the first layer and the third layer, and wherein the plurality of inlet holes pass through the first layer only, and wherein the plurality of radial passages are located in the second layer. In some such embodiments, the first layer and the third layer include a metal, and wherein the second layer includes a plastic. In some embodiments, the cone slants inwards at an angle of between about thirty degrees and about sixty degrees relative to the axis of rotation.

In some embodiments, the cone slants inwards at an angle of forty-five degrees relative to the axis of rotation.

In some embodiments, the plurality of radial passages extend radially outward such that a first distance is at least ninety to ninety-five percent of a second distance, wherein the first distance is measured from the axis of rotation to an end of one of the plurality of radial passages, and wherein the second distance is measured from the axis of rotation to the inner-wall surface of the centrifuge bowl.

In some embodiments, the plurality of radial passages extend radially outward such that a first distance is at least ninety-five to one hundred percent of a second distance, wherein the first distance is measured from the axis of rotation to an end of one of the plurality of radial passages, and wherein the second distance is measured from the axis of rotation to the inner-wall surface of the centrifuge bowl.

In some embodiments, each one of the plurality of inlet holes includes a chamfered underside, and wherein the chamfered underside prevents collection of liquid-borne particles within the plurality of inlet holes.

In some embodiments, each one of the plurality inlet holes includes an outward-slanted configuration, and wherein the outward-slanted configuration prevents collection of liquid-borne particles within the plurality of inlet holes.

In some embodiments, each one of the one or more scraper blades includes a blade tip that is aligned at an angle of eleven degrees relative to the inner-wall surface of the centrifuge bowl. In some such embodiments, each of the one or more scraper blades has a blade height at least as long as a height of the inner-wall surface of the centrifuge bowl, and wherein the one or more scraper blades includes a first scraper blade located along the inner-wall surface of the bowl and a second scraper blade located along the inner-wall surface of the bowl, and wherein the first scraper blade is located on an opposite side of the axis of rotation from the second scraper blade. In some embodiments, the one or more scraper blades include a first scraper blade located along the inner-wall surface of the bowl, and a second scraper blade located along the inner-wall surface of the bowl, and wherein the first scraper blade is located on an opposite side of the axis of rotation from the second scraper blade, and wherein the first scraper blade peels from a portion of the inner-wall surface not peeled by the second scraper blade, and wherein the second scraper blade peels from a portion of the inner-wall surface not peeled by the first scraper blade. In some embodiments, the one or more scraper blades include a first scraper blade located along the inner-wall surface of the bowl, a second scraper blade located along the inner-wall surface of the bowl, and a third scraper blade located along the inner-wall surface of the bowl, and wherein the first scraper blade and the second scraper blade are located on an opposite side of the axis of rotation from the third scraper blade, and wherein the first scraper blade peels from a portion of the inner-wall surface not peeled by the second scraper blade or the third scraper blade, and wherein the second scraper blade peels from a portion of the inner-wall surface not peeled by the first scraper blade or the third scraper blade, and wherein the third scraper blade peels from a portion of the inner-wall surface not peeled by the first scraper blade or the second scraper blade. Some embodiments further include a fourth scraper blade located along the inner-wall surface of the bowl, wherein the fourth scraper blade is located on an opposite side of the axis of rotation from the first scraper blade, and wherein the fourth scraper blade peels from a portion of the inner-wall surface also peeled by the first scraper blade. In some embodiments, the one or more scraper blades includes a first scraper blade located along the inner-wall surface of the bowl, and wherein the first scraper blade has a blade height at least as long as a height of the inner-wall surface of the bowl, and wherein the apparatus further includes a counter-weight, wherein the counter-weight has a size and a location such that the counter-weight balances a mass of the first scraper blade as it rotates around the inner-wall surface of the bowl.

In some embodiments, the present invention provides a method for extracting solids from an incoming particle-laden fluid, the method including rotating a centrifuge bowl at a centrifugally effective rate around an axis of rotation, wherein the bowl includes a cylindrical inner-wall surface and an open bottom, feeding particle-laden fluid into an upper portion of the centrifuge bowl, wherein the feeding includes: catching the particle-laden fluid, radially accelerating the particle-laden fluid to a first tangential speed, wherein the first tangential speed is close to a second tangential speed of the inner-wall surface of the centrifuge bowl, flowing the particle-laden fluid downward over the inner-wall surface of the centrifuge bowl, wherein the flowing includes separating solids from the particle-laden fluid by centrifugal force and depositing the solids on the inner-wall surface such that the particle-laden fluid becomes a centrifuged fluid, collecting the centrifuged fluid as it flows outward over a lip at the open bottom of the centrifuge bowl, reducing the feeding of the particle-laden fluid until the feeding is substantially stopped, slowing the rotating of the centrifuge bowl around the axis of rotation until the rotating is substantially stopped, peeling the solids off of the inner-wall surface, wherein the peeling includes collecting the solids as they drop through the open bottom of the centrifuge bowl, restarting the rotating of the centrifuge bowl, and restarting the feeding of the particle-laden fluid.

Some embodiments of this method further include continuing, for an effective amount of time, the rotating of the centrifuge bowl after slowing the feeding of the particle-laden fluid such that the removal of the centrifuged fluid still remaining in the centrifuge bowl can be completed, and the collected particles remain on the bowl wall.

In some embodiments, the slowing of the rotating of the centrifuge bowl includes locking the bowl in place.

In some embodiments, the peeling of the solids off of the inner-wall surface includes activating a tooth clutch operatively coupled to the centrifuge bowl.

In some embodiments, the feeding of the particle-laden fluid includes activating a plurality of pumps operatively coupled to the centrifuge bowl.

Some embodiments further include automatically controlling an operation of the centrifuge bowl, wherein the operation includes one or more of rotating, feeding, radially accelerating, flowing, collecting, slowing the feeding, slowing the rotating, peeling, restarting the rotating, and restarting the feeding.

In some embodiments, the restarting of the rotating of the centrifuge bowl includes rotating the centrifuge bowl without restarting the feeding of the particle-laden fluid, and, after an effective amount of time, slowing the rotating of the centrifuge bowl until it is substantially stopped such that a second phase of the peeling of the solids off of the inner-wall surface can be completed.

In some embodiments, the present invention provides a system that includes a vibratory finishing machine, wherein the vibratory finishing machine is configured to remove unwanted finish from an object, and wherein the vibratory finishing machine includes a combination of a media, a removal compound, and a third feed stream, and wherein the vibratory finishing machine is configured to output a low-flow, high-solids waste stream, a first centrifuge, wherein the first centrifuge is a high-efficiency, self-cleaning centrifuge, and wherein the first centrifuge is configured to clarify a first feed stream, and wherein the first centrifuge is configured to output a first output stream and a slurry, a second centrifuge, wherein the second centrifuge is configured to extract solids from a second feed stream, and wherein the second centrifuge is configured to output a second output stream and the process solids, and wherein the second centrifuge comprises a centrifuge bowl, wherein the bowl includes a cylindrical inner-wall surface and an open bottom, and wherein the bowl is configured to rotate around an axis of rotation, and wherein the bowl includes a bowl cover connected to a top of the centrifuge bowl, a particle-laden-fluid catcher fastened to an upper surface of the bowl cover, the fluid catcher having a smaller upper opening and a larger lower portion, the fluid catcher centered around the axis of rotation of the bowl and configured to rotate with the bowl, a plurality of radial passages each having in inner end and an outer end, each one of the plurality of radial passages configured to receive the particle-laden fluid at its inner end, and to extend radially outward such that the incoming particle-laden fluid as it travels through the plurality of radial passages is rotationally accelerated to a first rotational speed and is distributed uniformly around an upper portion of the inner-wall surface of the bowl at the first rotational speed, and wherein the first rotational speed is close to a second rotational speed of the inner-wall surface, wherein a layer of solids from the particle-laden fluid collects on the inner-wall surface of the bowl during operation of the apparatus, a fluid collection trough located around a perimeter of the open bottom of the centrifuge bowl and outside a cylinder defined by and extending from the open bottom of the centrifuge bowl, wherein the collection trough collects a centrifuged liquid that flows out of the bottom of the centrifuge bowl, one or more scraper blades located inside the centrifuge bowl, wherein the one or more scraper blades are configured to peel a layer of solids from the inner-wall surface of the bowl, a first drive mechanism operatively coupled to the centrifuge bowl, wherein the first drive mechanism operates to rotate the bowl in a centrifuge motion, a second drive mechanism operatively coupled to the one or more scraper blades, wherein the second drive mechanism provides power to rotate the one or more scraper blades around the inner-wall surface of the bowl, a slowing device operatively coupled to the centrifuge bowl, wherein the slowing device is configured to stop the bowl from its centrifuge motion and hold the bowl such that the scraper blades can peel the layer of solids from the bowl, a first feed tank, wherein the first feed tank is configured to receive the first output stream, and wherein the first feed tank is configured to supply the third feed stream for the vibratory finishing machine, a second feed tank, wherein the second feed tank is configured to receive and mix together the output waste stream from the vibratory finishing machine, the slurry from the first centrifuge, and the second output stream from the second centrifuge, and wherein the second feed tank includes a second pump configured to supply the second feed stream to the second centrifuge, and a third feed tank, wherein the third feed tank is configured to receive and mix together contents from the first feed tank and contents from the second feed tank, and wherein the third feed tank is configured to supply the first feed stream to the first centrifuge.

In some embodiments, the present invention provides a method removing unwanted finish from an object using a vibratory finishing machine, wherein the removing creates a low-flow, high-solids waste stream, clarifying the waste stream using a high-efficiency, self-cleaning first centrifuge, and wherein the clarifying creates a clarified stream and a slurry, pre-cleaning the waste stream before it is sent to the first centrifuge, wherein the pre-cleaning includes extracting solids from the waste stream using a second centrifuge, and wherein the pre-cleaning creates a dry-solids output stream and a pre-cleaned waste stream.

In some embodiments, this method includes mixing the slurry with the waste stream in a feed tank, wherein the mixing creates a mixed stream, and treating the mixed stream, wherein the treating includes extracting solids from the mixed stream using the second centrifuge.

In some embodiments, the present invention provides a centrifuge apparatus for extracting solids from an incoming particle-laden fluid. This the apparatus includes a centrifuge bowl, wherein the bowl includes a cylindrical inner-wall surface and an open bottom, and wherein the bowl is configured to rotate around an axis of rotation, and wherein the bowl includes a bowl cover connected to a top of the centrifuge bowl, a particle-laden-fluid catcher fastened to an upper surface of the bowl cover, the fluid catcher having a smaller upper opening and a larger lower portion, the fluid catcher centered around the axis of rotation of the bowl and configured to receive the incoming particle-laden fluid, a plurality of outward-directed passages each having in inner end and an outer end, each one of the plurality of outward-directed passages configured to receive the particle-laden-fluid from the catcher at its inner end, and to extend outward such that the incoming particle-laden-fluid as it travels through the plurality of outward-directed passages is rotationally accelerated to a first rotational speed and is distributed substantially uniformly around an upper portion of the inner-wall surface of the bowl at the first rotational speed, and wherein the first rotational speed is close to a second rotational speed of the inner-wall surface, wherein a layer of solids from the particle-laden-fluid collects on the inner-wall surface of the bowl during operation of the apparatus, one or more peeler blades located inside the centrifuge bowl, wherein the one or more blades are configured be moved relative to the bowl to peel a layer of solids from the inner-wall surface of the bowl, and a slowing device operatively coupled to the centrifuge bowl, wherein the slowing device is configured to slow the bowl from its centrifugal motion and hold the bowl in a substantially stopped position while the blades peel the layer of solids from the bowl.

Some embodiments of this apparatus further include a stand, wherein the slowing device includes a disk brake having a brake disk in a fixed relationship to the bowl and a caliper operatively coupled to the stand.

In some embodiments of this apparatus, the slowing device includes a disk brake operable to slow the bowl from its centrifugal motion and a retractable pin-type locking mechanism operable to hold the bowl in a substantially stopped position while the blades peel the layer of solids from the bowl.

In some embodiments of this apparatus, each of the one or more peeler blades includes a curling surface.

Some embodiments of this apparatus further include a plurality of pumps operatively coupled to the one or more inlet ducts, wherein the plurality of pumps are configured to push the incoming liquid through the centrifuge, and a control module operatively coupled to the first drive mechanism, the second drive mechanism, the slowing device, and the plurality of pumps, wherein the control module is configured to automatically control the operation of the centrifuge, and wherein the operation of the centrifuge includes a centrifuge mode interleaved with a peeling mode.

In some embodiments of this apparatus, the bowl cover includes a plurality of inlet holes through the bowl cover that are positioned at a maximum inside diameter of the particle-laden-fluid catcher, and wherein each one of the plurality of inlet holes connects to a corresponding one of the plurality of outward-directed passages, and wherein the particle-laden-fluid catcher is shaped as a section of a cone such that an incoming liquid entering the cone during rotation will flow to the larger-diameter lowest end of the cone and pass through the inlet holes in the bowl cover without depositing solids on an inside surface of the particle-laden-fluid catcher.

In some embodiments of this apparatus, the bowl cover includes a first layer, a second layer, and a third layer, and wherein the second layer is located in between the first layer and the third layer, and wherein second layer is made as a single piece with the particle-laden-fluid catcher, and wherein the plurality of outward-directed passages are located, at least in part, in the second layer and lead from the particle-laden-fluid catcher at their inner ends and include side walls that extend to substantially the inner diameter of the bowl at the outer ends of the outward-directed passages.

In some embodiments of this apparatus, the particle-laden-fluid catcher includes a cone section that slants inwards at an angle of between about thirty degrees and about sixty degrees relative to the axis of rotation.

In some embodiments of this apparatus, the plurality of outward-directed passages extend radially outward such that a first distance is between about ninety percent and one hundred percent of a second distance, wherein the first distance is from the axis of rotation to an end of one of the plurality of radial passages, and wherein the second distance is from the axis of rotation to the inner-wall surface of the centrifuge bowl.

In some embodiments of this apparatus, each one of the one or more blades includes a blade tip that is oriented at an angle of substantially eleven degrees relative to a tangent line of the inner-wall surface of the centrifuge bowl.

In some embodiments of this apparatus, each of the one or more peeler blades has a blade height substantially as long as a height of the inner-wall surface of the centrifuge bowl, and wherein the one or more peeler blades include a first peeler blade located along the inner-wall surface of the bowl and a second peeler blade located along the inner-wall surface of the bowl, and wherein the first peeler blade is located on an opposite side of the axis of rotation from the second peeler blade.

In some embodiments of this apparatus, the one or more peeler blades include a first peeler blade located along the inner-wall surface of the bowl, and a second peeler blade located along the inner-wall surface of the bowl, and wherein the first peeler blade is located on an opposite side of the axis of rotation from the second peeler blade, and wherein the first peeler blade peels from a portion of the inner-wall surface not peeled by the second peeler blade, and wherein the second peeler blade peels from a portion of the inner-wall surface not peeled by the first peeler blade.

In some embodiments of this apparatus, the one or more peeler blades include a first peeler blade located along the inner-wall surface of the bowl, a second peeler blade located along the inner-wall surface of the bowl, and a third peeler blade located along the inner-wall surface of the bowl, and wherein the first peeler blade and the second peeler blade are located on an opposite side of the axis of rotation from the third peeler blade, and wherein the first peeler blade peels from a portion of the inner-wall surface not peeled by the second peeler blade or the third peeler blade, and wherein the second peeler blade peels from a portion of the inner-wall surface not peeled by the first peeler blade or the third peeler blade, and wherein the third peeler blade peels from a portion of the inner-wall surface not peeled by the first peeler blade or the second peeler blade. Some embodiments further include a fourth peeler blade located along the inner-wall surface of the bowl and having a top edge at a height substantially equal to a height of a top edge of the first blade, wherein the fourth peeler blade is located on an opposite side of the axis of rotation from the first peeler blade, and wherein the fourth peeler blade peels from a portion of the inner-wall surface also peeled by the first peeler blade.

Some embodiments further include a vibratory-finishing machine, wherein the vibratory finishing machine is configured to remove unwanted finish from an object, and wherein the vibratory-finishing machine uses a combination of a media, a removal compound, and a clarified fluid, and wherein the vibratory-finishing machine is configured to output a high-flow, low-solids waste stream, and a high-efficiency, self-cleaning centrifuge, and wherein the high-efficiency centrifuge is configured to receive and clarify the high-flow, low-solids waste stream, and to output the clarified fluid, feed the clarified fluid to the vibratory-finishing machine and to output a low-flow, high-solids waste stream, wherein the apparatus is configured to feed the low-flow, high-solids slurry into the particle-laden-fluid catcher of the present invention.

In some embodiments, the present invention provides a method for extracting solids from an incoming particle-laden fluid This method includes rotating a centrifuge bowl at a centrifugally effective rate around an axis of rotation, wherein the bowl includes a cylindrical inner-wall surface and an open bottom, wherein the rotating achieves a first tangential speed of the inner-wall surface of the centrifuge bowl, feeding particle-laden fluid into an upper portion of the centrifuge bowl (wherein the feeding includes: catching the particle-laden fluid, radially accelerating the particle-laden fluid to a second tangential speed, wherein the second tangential speed is close to the first tangential speed of the inner-wall surface of the centrifuge bowl, and flowing the particle-laden fluid downward over the inner-wall surface of the centrifuge bowl, wherein the flowing includes accumulating solids from the particle-laden fluid by centrifugal force onto the inner-wall surface such that the particle-laden fluid becomes a centrifuged fluid that exits the bowl), reducing the feeding of the particle-laden fluid until the feeding is substantially stopped, slowing the rotating of the centrifuge bowl around the axis of rotation until the rotating is substantially stopped, peeling the solids off of the inner-wall surface, wherein the peeling includes collecting the solids as they drop through the open bottom of the centrifuge bowl, restarting the rotating of the centrifuge bowl, and restarting the feeding of the particle-laden fluid.

Some embodiments of the method further include continuing, for an effective amount of time, the rotating of the centrifuge bowl after slowing the feeding of the particle-laden fluid such that the removal of the centrifuged fluid still remaining in the centrifuge bowl is completed, and the accumulated particles remain on the bowl wall.

Some embodiments of the method further include automatically controlling operations of the centrifuge bowl, wherein the operation includes the rotating of the bowl, the feeding of the particle-laden fluid, the slowing of the feeding, the slowing of the rotating, the peeling, the restarting of the rotating, and the restarting of the feeding.

Some embodiments of the method further include removing unwanted material from an object, wherein the removing creates a high-flow, low-solids waste stream, clarifying the high-flow, low-solids waste stream, wherein the clarifying creates a clarified stream and a low-flow, high-solids waste stream that comprises the particle-laden fluid.

In some embodiments, the present invention provides an apparatus for extracting solids from an incoming particle-laden fluid. This apparatus includes a centrifuge bowl, wherein the bowl includes a cylindrical inner-wall surface and an open bottom, means for rotating the centrifuge bowl at a centrifugally effective rate around an axis of rotation, wherein the rotating achieves a first tangential speed of the inner-wall surface of the centrifuge bowl, means for feeding and radially accelerating the particle-laden fluid to a second tangential speed, wherein the second tangential speed is close to the first tangential speed of the inner-wall surface of the centrifuge bowl, and for accumulating solids from the particle-laden fluid on the inner-wall surface, and means for peeling the solids off of the inner-wall surface so they drop through the open bottom of the centrifuge bowl.

Some embodiments further include means for stopping the means for feeding of the particle-laden fluid, and means for spin-drying the solids after stopping the means for feeding and before operation of the means for peeling.

Some embodiments further include means for automatically controlling the means for rotating, the means for feeding and radially accelerating the particle-laden fluid, and the means for peeling.

Some embodiments further include means for removing unwanted material from an object, wherein the means for removing creates a high-flow, low-solids waste stream, means for clarifying the high-flow, low-solids waste stream, and wherein the means for clarifying creates a clarified stream and a low-flow, high-solids waste stream that comprises the particle-laden fluid, wherein the means to separate and dump the near dry solid waste.

It is specifically contemplated that some embodiments of the invention include combinations of the various separately described embodiments described above, and/or subcombinations that omit one or more features of certain embodiments.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A centrifuge apparatus for extracting solids from an incoming particle-laden fluid, the apparatus comprising:

a centrifuge bowl, wherein the bowl includes a cylindrical inner-wall surface and an open bottom, and wherein the bowl is configured to rotate around an axis of rotation, and wherein the bowl includes a bowl cover connected to a top of the centrifuge bowl;

a particle-laden-fluid catcher fastened to an upper surface of the bowl cover, the fluid catcher having a smaller upper opening and a larger lower portion, the fluid catcher centered around the axis of rotation of the bowl and configured to receive the incoming particle-laden fluid;

a plurality of outward-directed passages each having an inner end and an outer end, each one of the plurality of outward-directed passages configured to receive the particle-laden-fluid from the catcher at its inner end, and to extend outward such that the incoming particle-laden-fluid as it travels through the plurality of outward-directed passages is rotationally accelerated to a first rotational speed and is distributed substantially uniformly around an upper portion of the inner-wall surface of the bowl at the first rotational speed, and wherein the first rotational speed is close to a second rotational speed of the inner-wall surface, wherein a layer of solids from the particle-laden-fluid collects on the inner-wall surface of the bowl during operation of the apparatus;

one or more peeler blades located inside the centrifuge bowl, wherein the one or more blades are configured to be moved relative to the bowl to peel a layer of solids from the inner-wall surface of the bowl; and a slowing device operatively coupled to the centrifuge bowl, wherein the slowing device is configured to slow the bowl from its centrifugal motion and hold the bowl in a substantially stopped position while the blades peel the layer of solids from the bowl.

2. The apparatus of claim 1, further comprising a stand, wherein the slowing device includes a disk brake having a brake disk in a fixed relationship to the bowl and one or more calipers operatively coupled to the stand.

3. The apparatus of claim 1, wherein the slowing device includes a disk brake operable to slow the bowl from its centrifugal motion and a retractable pin-type locking mechanism operable to hold the bowl in a substantially stopped position while the blades peel the layer of solids from the bowl.

4. The apparatus of claim 1, wherein each of the one or more peeler blades includes a curling surface.

5. The apparatus of claim 1, further comprising:

a plurality of pumps operatively coupled to the one or more inlet ducts, wherein the plurality of pumps are configured to push the incoming liquid through the centrifuge; and a control module operatively coupled to the first drive mechanism, the second drive mechanism, the slowing device, and the plurality of pumps, wherein the control module is configured to automatically control the operation of the centrifuge, and wherein the operation of the centrifuge includes a centrifuge mode interleaved with a peeling mode.

6. The apparatus of claim 1, wherein the bowl cover includes a plurality of inlet holes through the bowl cover that are positioned at a maximum inside diameter of the particle-laden-fluid catcher, and wherein each one of the plurality of inlet holes connects to a corresponding one of the plurality of outward-directed passages, and wherein the particle-laden-fluid catcher is shaped as a section of a cone such that an incoming liquid entering the cone during rotation will flow to the larger-diameter lowest end of the cone and pass through the inlet holes in the bowl cover without depositing solids on an inside surface of the particle-laden-fluid catcher.

7. The apparatus of claim 6, wherein the bowl cover includes a first layer, a second layer, and a third layer, and wherein the second layer is located in between the first layer and the third layer, and wherein second layer is made as a single piece with the particle-laden-fluid catcher, and wherein the plurality of outward-directed passages are located, at least in part, in the second layer and lead from the particle-laden-fluid catcher at their inner ends and include side walls that extend to substantially the inner diameter of the bowl at the outer ends of the outward-directed passages.

8. The apparatus of claim 6, wherein the particle-laden-fluid catcher includes a cone section that slants inwards at an angle of between about thirty degrees and about sixty degrees relative to the axis of rotation.

9. The apparatus of claim 1, wherein the plurality of outward-directed passages extend radially outward such that a first distance is between about ninety percent and one hundred percent of a second distance, wherein the first distance is from the axis of rotation to an end of one of the plurality of radial passages, and wherein the second distance is from the axis of rotation to the inner-wall surface of the centrifuge bowl.

10. The apparatus of claim 1, wherein each one of the one or more blades includes a blade tip that is oriented at an angle of substantially eleven degrees relative to a tangent line of the inner-wall surface of the centrifuge drum.

11. The apparatus of claim 1, wherein each of the one or more peeler blades has a blade height substantially as long as a height of the inner-wall surface of the centrifuge bowl, and wherein the one or more peeler blades include a first peeler blade located along the inner-wall surface of the bowl and a second peeler blade located along the inner-wall surface of the bowl, and wherein the first peeler blade is located on an opposite side of the axis of rotation from the second peeler blade.

12. The apparatus of claim 1, wherein the one or more peeler blades include a first peeler blade located along the inner-wall surface of the bowl, and a second peeler blade located along the inner-wall surface of the bowl, and wherein the first peeler blade is located on an opposite side of the axis of rotation from the second peeler blade, and wherein the first peeler blade peels from a portion of the inner-wall surface not peeled by the second peeler blade, and wherein the second peeler blade peels from a portion of the inner-wall surface not peeled by the first peeler blade.

13. The apparatus of claim 1, wherein the one or more peeler blades include a first peeler blade located along the inner-wall surface of the bowl, a second peeler blade located along the inner-wall surface of the bowl, and a third peeler blade located along the inner-wall surface of the bowl, and wherein the first peeler blade and the second peeler blade are located on an opposite side of the axis of rotation from the third peeler blade, and wherein the first peeler blade peels from a portion of the inner-wall surface not peeled by the second peeler blade or the third peeler blade, and wherein the second peeler blade peels from a portion of the inner-wall surface not peeled by the first peeler blade or the third peeler blade, and wherein the third peeler blade peels from a portion of the inner-wall surface not peeled by the first peeler blade or the second peeler blade.

14. The apparatus of claim 13, further comprising a fourth peeler blade located along the inner-wall surface of the bowl and having a top edge at a height substantially equal to a height of a top edge of the first blade, wherein the fourth peeler blade is located on an opposite side of the axis of rotation from the first peeler blade, and wherein the fourth peeler blade peels from a portion of the inner-wall surface also peeled by the first peeler blade.

15. The apparatus of claim 1, in a system further comprising:

a vibratory-finishing machine, wherein the vibratory finishing machine is configured to remove unwanted finish from an object, and wherein the vibratory-finishing machine uses a combination of a media, a removal compound, and a clarified fluid, and wherein the vibratory-finishing machine is configured to output a high-flow, low-solids waste stream; and a high-efficiency, self-cleaning centrifuge, and wherein the high-efficiency centrifuge is configured to receive and clarify the high-flow, low-solids waste stream, and to output the clarified fluid to the vibratory-finishing machine and to output a low-flow, high-solids waste stream, wherein the apparatus is configured to feed the low-flow, high-solids slurry into the particle-laden-fluid catcher and to feed the clarified fluid to the vibratory-finishing machine.

16. The apparatus of claim 1, wherein the centrifuge bowl has no lip at its open bottom.

* * * * *